US010895095B2

(12) United States Patent
Cumbo

(10) Patent No.: US 10,895,095 B2
(45) Date of Patent: Jan. 19, 2021

(54) POWER CLOSURE LATCH ASSEMBLY WITH CINCH MECHANISM HAVING RATCHET RETENTION FUNCTION

(71) Applicant: Magna Closures Inc., Newmarket (CA)

(72) Inventor: Francesco Cumbo, Pisa (IT)

(73) Assignee: MAGNA CLOSURES S.P.A., Guasticce (IT)

( * ) Notice: Subject to any disclaimer, the term of this patent is extended or adjusted under 35 U.S.C. 154(b) by 644 days.

(21) Appl. No.: 15/716,876

(22) Filed: Sep. 27, 2017

(65) Prior Publication Data

US 2018/0100331 A1 Apr. 12, 2018

Related U.S. Application Data

(60) Provisional application No. 62/404,864, filed on Oct. 6, 2016.

(51) Int. Cl.
*E05B 81/20* (2014.01)
*E05B 81/68* (2014.01)
*E05B 81/64* (2014.01)

(52) U.S. Cl.
CPC ..... *E05B 81/20* (2013.01); *E05B 81/68* (2013.01); *E05B 81/64* (2013.01)

(58) Field of Classification Search
CPC .... E05B 81/20; E05B 81/14; Y10T 292/1082; Y10T 292/1047; Y10T 292/699; Y10S 292/23; E05C 3/12
See application file for complete search history.

(56) References Cited

U.S. PATENT DOCUMENTS

| | | | | |
|---|---|---|---|---|
| 5,639,130 | A * | 6/1997 | Rogers, Jr. | E05B 81/20 292/199 |
| 5,918,917 | A * | 7/1999 | Elton | E05B 81/20 292/201 |
| 6,053,542 | A * | 4/2000 | Ostrowski | E05B 81/20 292/201 |
| 6,123,372 | A * | 9/2000 | Rogers, Jr. | E05B 81/20 292/201 |
| 6,341,448 | B1 * | 1/2002 | Murray | E05B 81/20 49/280 |
| 6,848,727 | B1 | 2/2005 | Cetnar et al. | |
| 7,175,212 | B2 | 2/2007 | Cetnar et al. | |
| 7,261,334 | B2 | 8/2007 | Oberheide et al. | |
| 10,378,252 | B2 | 8/2019 | Ottino et al. | |
| 2002/0000725 | A1 * | 1/2002 | Ostrowski | E05B 81/20 292/199 |
| 2005/0121922 | A1 * | 6/2005 | Cetnar | E05B 81/20 292/216 |
| 2005/0184534 | A1 * | 8/2005 | Oberheide | E05B 81/20 292/201 |

(Continued)

FOREIGN PATENT DOCUMENTS

| | | | |
|---|---|---|---|
| EP | 0978609 | A1 | 2/2000 |
| EP | 1176273 | A2 | 1/2002 |
| WO | 2008061491 | A1 | 5/2008 |

*Primary Examiner* — Mark A Williams
(74) *Attorney, Agent, or Firm* — Dickinson Wright PLLC

(57) ABSTRACT

A closure latch assembly for a vehicular closure system equipped with a latch cinch mechanism for providing a cinching feature and which is configured to retain a ratchet of a latch mechanism in a secondary striker capture position such that the latch mechanism is only required to hold the ratchet in a primary striker capture position.

20 Claims, 12 Drawing Sheets

(56) References Cited

U.S. PATENT DOCUMENTS

| | | | | |
|---|---|---|---|---|
| 2008/0073917 | A1* | 3/2008 | Ciavaglia | E05B 81/20 292/201 |
| 2012/0299313 | A1* | 11/2012 | Organek | E05B 81/20 292/129 |
| 2016/0186468 | A1* | 6/2016 | Ilea | E05B 83/18 292/201 |
| 2017/0089103 | A1 | 3/2017 | Ottino et al. | |
| 2017/0089105 | A1 | 3/2017 | Margheritti | |
| 2018/0171677 | A1* | 6/2018 | Im | E05B 83/16 |
| 2018/0171679 | A1* | 6/2018 | Im | E05B 81/66 |

* cited by examiner

POWER CLOSURE LATCH ASSEMBLY WITH CINCH MECHANISM HAVING RATCHET RETENTION FUNCTION

CROSS-REFERENCE TO RELATED APPLICATIONS

This application claims the benefit of U.S. Provisional Application No. 62/404,864, filed on Oct. 6, 2016. The entire disclosure of the above application is incorporated herein by reference.

FIELD OF THE INVENTION

The present disclosure relates generally to closure latch assemblies of the type used in motor vehicle closure systems for controlling the locking and release of a closure panel. More particularly, the present disclosure relates to a power-operated closure latch assembly providing a power cinching feature and being equipped with a latch cinch mechanism having a ratchet retention function.

BACKGROUND OF THE INVENTION

This section provides background information related to the present disclosure which is not necessarily prior art.

In view of increased consumer demand for motor vehicles equipped with advanced comfort and convenience features, many modern motor vehicles are now provided with passive entry systems to permit locking and release of closure panels (i.e., doors, tailgates, liftgates and decklids) without use of a traditional key-type entry system. In this regard, some popular features now available with vehicle latch systems include power locking/unlocking, power release and power cinching. These "powered" features are provided by a closure latch assembly mounted to the closure panel and which is typically equipped with a ratchet and pawl type of latch mechanism controlled via at least one power-operated actuator. Typically, the closure panel is held in a closed position by virtue of the ratchet being held in a striker capture position to releaseably retain a striker that is mounted to a structural body portion of the vehicle. The ratchet is held in its striker capture position by the pawl engaging the ratchet when the pawl is located in a ratchet holding position. In many ratchet and pawl type of latch mechanisms, the pawl is operable in its ratchet holding position to retain the ratchet in one of a secondary or "soft close" striker capture position and a primary or "hard close" striker capture position. When the ratchet is held by the pawl in its secondary striker capture position, the latch mechanism functions to latch the closure panel in a partially-closed position relative to the body portion of the vehicle. Likewise, when the ratchet is held by the pawl in its primary striker capture position, the latch mechanism functions to latch the closure panel in a fully-closed position relative to the body portion of the vehicle.

Closure latch assemblies providing a power cinching feature, also referred to as a "soft close" function, are usually equipped with a latch cinch mechanism operated by a power-operated cinch actuator. Commonly, the latch cinch mechanism is directly connected to the ratchet and, when actuated, is operable for causing the ratchet to move from its secondary striker capture position into its primary striker capture position, thereby moving (i.e. cinching) the closure panel from its partially-closed position into its fully-closed position. To subsequently release the closure panel from its fully-closed position, a latch release mechanism is actuated for moving the pawl from its ratchet holding position into a ratchet releasing position, whereby a ratchet biasing arrangement, in cooperation with the seal loads exerted on the striker, act to forcibly pivot the ratchet from its primary striker capture position into a striker release position. With the ratchet located in its striker release position, the latch mechanism unlatches the closure panel for subsequent movement toward its open position. In closure latch assemblies providing a power release feature, the latch release mechanism is typically controlled by a power-operated release actuator. A single power-operated actuator, or separate power-operated actuators, can be used in association with the power release and power cinching features. However, the power release feature is typically independent from the power cinching feature.

In most closure latch assemblies providing the power cinching feature, the latch cinch mechanism is normally maintained in a non-actuated or "cinch-ready" state and is only actuated once sensors detect that the ratchet is located in its secondary striker capture position. Following completion of the power cinching operation, when the sensors indicate that the ratchet is located in its primary striker capture position, the latch cinch mechanism is shifted into a "cinch-stop" state. Thereafter, the latch cinch mechanism must be "reset", that is returned to its cinch-ready state, to permit subsequent uninhibited movement of the ratchet to its striker release position via actuation (i.e. manual or power release) of the latch release mechanism. However, if the closure panel is initially closed with a sufficient closing force to locate the ratchet in its primary striker capture position, then the power cinching operation is bypassed and the latch cinch mechanism is retained in its cinch-ready state.

A problem associated with some conventional closure latch assemblies providing a power cinching feature is proper detection of the correct latched state of the latch mechanism. Specifically, some closure latch assemblies providing a soft close function use AJAR and PAWL switches to identify the current operative state and, more specifically, to identify the position of the ratchet with respect to its secondary and primary striker capture positions. The status of these two switches is used to start and stop the power cinching operation and typically utilize a status change in the PAWL switch to start the power cinching operation and a status change in both the PAWL and AJAR switch to stop the power cinching operation. When the ratchet reaches its secondary striker capture position, the pawl is permitted to rotate into its ratchet holding position which activates the PAWL switch. During rotation of the ratchet from its secondary striker capture position into its primary striker capture position, the pawl initially returns to its ratchet releasing position where it engages and follows along an edge profile surface of the ratchet. As such, the PAWL switch is temporarily de-activated. When the ratchet reaches its primary striker capture position, the pawl again moves into its ratchet holding position and causes re-activation of the PAWL switch. Additionally, the ratchet typically causes activation of a RATCHET switch to indicate that the ratchet is located in its primary striker capture position. However, if the seal forces and/or the orientation of the vehicle result in the closure pawl being positioned such that the ratchet is rotated beyond the secondary striker capture position by the striker but short of its primary striker capture position, it is possible that the pawl will be located in its ratchet releasing position and the PAWL switch maintained in its temporarily de-activated state (which appears the same as the closure pawl being located in its open position), whereby the power cinching operation will not be initiated, which is undesirably recognized by the vehicle operator as a system malfunction.

While current power closure latch assemblies are sufficient to meet regulatory requirements and provide enhanced comfort and convenience, a need still exists to advance the technology and provide alternative power-operated features and arrangements that address and overcome at least some of the known shortcomings.

SUMMARY OF THE INVENTION

This section provides a general summary of the disclosure and is not intended to be a comprehensive listing of all features, advantages, aspects and objectives associated with the inventive concepts described and illustrated in the detailed description provided herein.

It is an aspect of the present disclosure to provide a power closure latch assembly for a motor vehicle closure system configured to provide a power cinching feature.

It is a related aspect of the present disclosure to provide the power closure latch assembly with a power-operated latch cinch mechanism operable to cinch a striker, retained by a ratchet of a ratchet and pawl type of latch mechanism, by moving the ratchet from an uncinched/soft close ("secondary striker capture") position into a cinched/hard close ("primary striker capture") position.

It is another related aspect of the present disclosure to establish a Cinch mode when the power-operated latch cinch mechanism engages and forcibly drives the ratchet from its secondary striker capture position into its primary striker capture position. In addition, a Cinch Disengage mode is established when a power-operated cinch disengage mechanism disengages the latch cinch mechanism from engagement with the ratchet.

It is another related aspect of the present disclosure to utilize the power-operated latch cinch mechanism to mechanically hold the ratchet in its secondary striker capture position such that the pawl is only used in its ratchet holding position to mechanically hold the ratchet in its primary striker capture position.

It is another related aspect of the present disclosure to utilize the power-operated latch cinch mechanism to maintain engagement with the ratchet during movement of the ratchet from its secondary striker capture position into its primary striker capture position.

In accordance with these and other aspects, a closure latch assembly for use with a closure panel in a motor vehicle, comprises: a ratchet moveable between a striker release position whereat the ratchet is positioned to release a striker, secondary and primary striker capture positions whereat the ratchet is positioned to retain the striker, and a ratchet overtravel position, the ratchet being biased toward its striker release position; a pawl moveable between a ratchet holding position whereat the pawl is positioned to hold the ratchet in its primary striker capture position and a ratchet releasing position whereat the pawl is located to permit movement of the ratchet to its striker release position, the pawl being biased toward its ratchet holding position, and being permitted to move into its ratchet holding position when the ratchet is moved into its ratchet overtravel position; a latch cinch mechanism including a cinch lever operably interconnected to a cinch link, the cinch link being moveable between a cinch link engaged position whereat the cinch link engages and holds the ratchet in its secondary striker capture position and a cinch link disengage position whereat the cinch link is disengaged from the ratchet, the cinch lever being moveable from a cinch start position to a cinch stop position while the cinch link is located in its cinch link engaged position for causing the cinch link to move from an uncinched position to a cinched position for causing corresponding movement of the ratchet from its secondary striker capture position into is ratchet overtravel position; a power cinch actuator operable in a cinching state to move the cinch lever from its cinch start position to its cinch stop position and in a resetting state to move the cinch lever from its cinch stop position to its cinch start position so as to allow the ratchet to move from its ratchet overtravel position to its primary striker capture position with the pawl located in its ratchet holding position for engaging and holding the ratchet in its primary striker capture position.

The above-described closure latch assembly of the present disclosure further comprises a cinch disengage mechanism operable for moving the cinch link from its cinch link engaged position to its cinch link disengaged position after the ratchet is held in its primary striker capture position by the pawl in its ratchet holding position. The cinch disengage mechanism includes a disengage lever operatively connected to the cinch link such that movement of the disengage lever between a non-actuated position and an actuated position causes coordinated movement of the cinch link between its cinch link engaged and cinch link disengaged positions. The closure latch assembly further including a power cinch disengage actuator operable for moving the disengage lever between its non-actuated and actuated positions.

The above-described closure latch assembly of the present disclosure further comprises: a pawl switch operable to detect and provide a pawl position signal when the pawl is located in its ratchet releasing position; a disengage lever switch operable to detect and provide a disengage lever position signal when the disengage lever is located in its actuated position; and a cinch home switch operable to detect and provide a cinch home signal when the cinch link is located in its uncinched position.

The above-described closure latch assembly of the present disclosure further comprises: a latch release mechanism coupled to the pawl and operable in a non-actuated state to hold the pawl in its ratchet holding position and in an actuated state to move the pawl to its ratchet releasing position; a power release actuator for shifting the latch release mechanism between its non-actuated and actuated states; a cinch disengage mechanism operable in a non-actuated state to permit the cinch link to be located in its cinch link engaged position and in an actuated state to move the cinch link to its cinch link disengaged position; and a power cinch disengage actuator for shifting the cinch disengage mechanism between its non-actuated and actuated states. The cinch disengage mechanism includes a disengage lever connected to the cinch link such that movement of the disengage lever from between a first position and a second position causes coordinated movement of the cinch link between its cinch link engaged and cinch link disengaged positions. The power cinch disengage actuator is operable to move the disengage lever from its first position to its second position to shift the cinch disengage mechanism from its non-actuated state into its actuated state.

In accordance with these and other aspects, a power closure latch assembly is provided which comprises: a ratchet moveable between a striker release position whereat the ratchet is positioned to release a striker and two distinct striker capture positions whereat the ratchet is positioned to retain the striker, wherein the two distinct striker capture positions include a soft close/uncinched ("secondary striker capture") position and a hard close/cinched ("primary striker capture") position; a ratchet biasing member for normally biasing the ratchet toward its striker release position; a pawl moveable between a ratchet holding position whereat the pawl is positioned to hold the ratchet in its primary striker capture position and a ratchet releasing position whereat the pawl is located to permit movement of the ratchet toward its striker release position; a pawl biasing member for normally biasing the pawl toward its ratchet holding position; a latch release mechanism operable to selectively move the pawl from its ratchet holding position into its ratchet releasing position; a power release actuator operable for controlling actuation of the latch release mechanism; a latch cinch mechanism including a cinch lever operably interconnected to a cinch link, wherein the cinch link is moveable between a cinch link engaged position whereat the cinch link holds the ratchet in its secondary striker capture position and a cinch link disengage position whereat the cinch link is disengaged from the ratchet, wherein movement of the cinch lever from a cinch start position to a cinch stop position while the cinch link is located in its cinch link engaged position causes the cinch link to move from an uncinched position to a cinched position for causing corresponding movement of the ratchet from its secondary striker capture position into is primary striker capture position; and a power cinch actuator operable for moving the cinch lever between its cinch start and cinch stop positions.

The power closure latch assembly of the present disclosure is further configured to include a cinch disengage mechanism and a power cinch disengage actuator, wherein the cinch disengage mechanism is operable for moving the cinch link from its cinch link engaged position to its cinch link disengaged positions. The cinch disengage mechanism includes a disengage lever that is operatively connected to the cinch link such that movement of the disengage lever between a non-actuated position and an actuated position causes coordinated movement of the cinch link between its cinch link engaged and cinch link disengaged positions. The power cinch disengage actuator is operable for controlling movement of the disengage lever between its non-actuated and actuated positions.

The power closure latch assembly of the present disclosure is further configured to include a pawl switch operable to detect and provide a pawl position signal when the pawl is located in its ratchet releasing position, a disengage lever switch operable to detect and provide a disengage lever position signal when the disengage lever is located in its actuated position, and a cinch home switch operable to detect and provide a cinch home position signal when the cinch link is moved to its uncinched position indicative of movement of the ratchet in a cinching direction past its primary striker capture position into a ratchet overtravel position.

It is a related aspect of the present disclosure to provide the power closure latch assembly with a power-operated latch cinch mechanism operable to cinch the striker retained by the ratchet of the ratchet and pawl type of latch mechanism by moving the ratchet from its secondary striker capture position into its primary striker capture position. The power-operated latch cinch mechanism is operable in a Cinch Start state to forcibly move the ratchet in the cinching direction from its secondary striker capture position, past its primary striker capture position, and into its ratchet overtravel position for defining a Cinch Stop state. The pawl of the latch mechanism moves from its ratchet releasing position into its ratchet holding position when the ratchet is located in its ratchet overtravel position. A Cinch Homing state is also established when the power-operated latch cinch mechanism moves the ratchet from its ratchet overtravel position into its primary striker capture position (which is maintained via engagement with the pawl in its ratchet holding position) and the subsequent resetting of the latch cinch mechanism to its Cinch Start state.

Further areas of applicability will become apparent from the detailed description provided herein. The description and specific examples in this summary are intended for purposes of illustration only and are not intended to limit the scope of the present disclosure.

DRAWINGS

The drawings described herein are for illustrative purposes only of selected embodiment(s) and not all possible implementations such that the drawings are not intended to limit the scope of the present disclosure.

Figure 16:
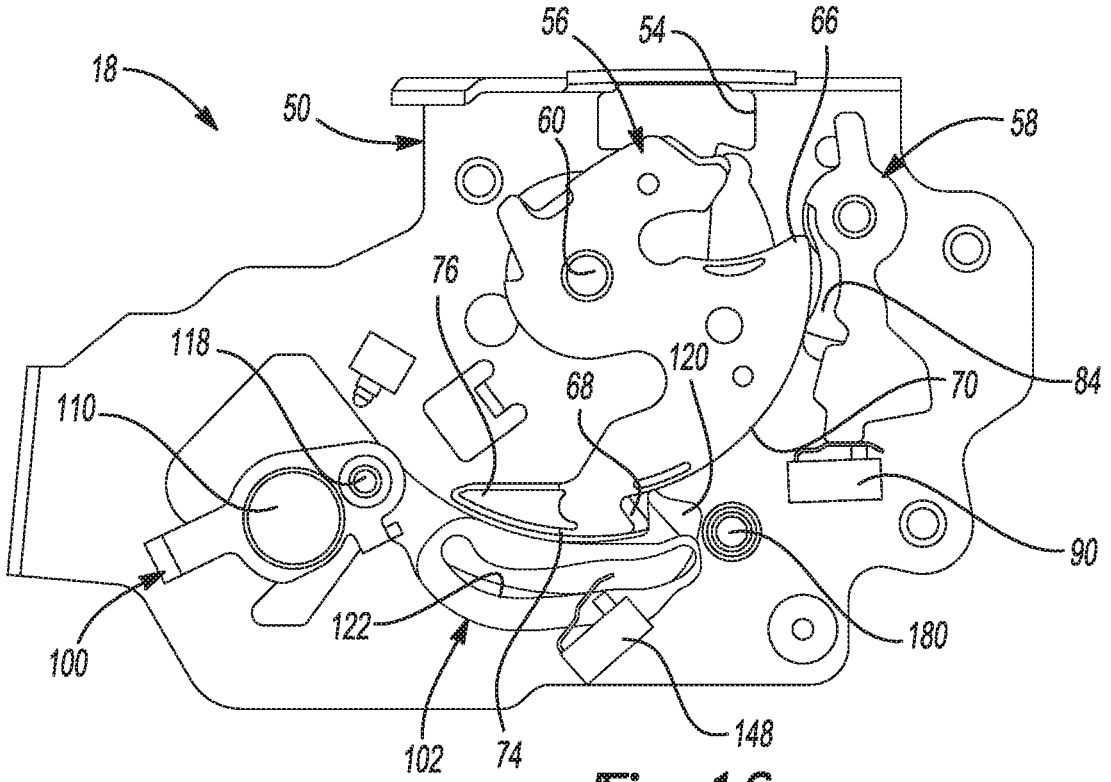
Figure 17:
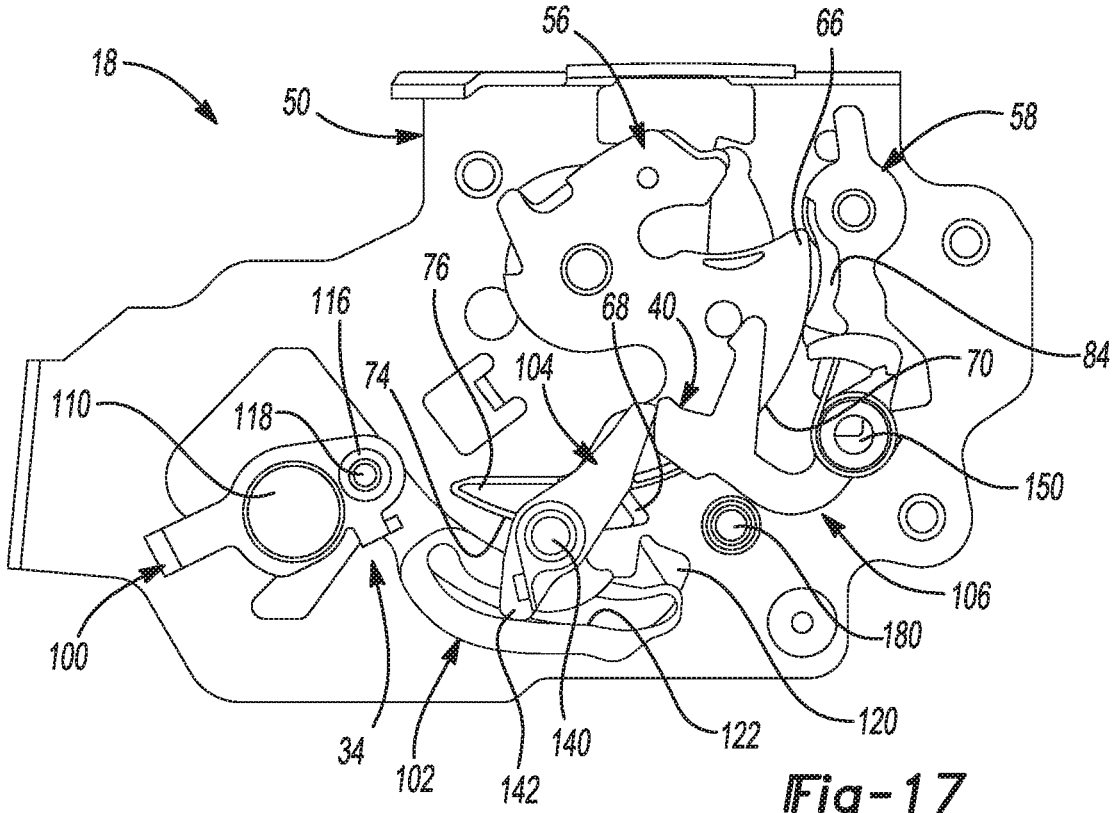

FIGS. 13A-13B, 14A-14B, and 15A-15B are elevational views sequentially illustrating a power cinching function and a power cinch homing function provided by the power closure latch assembly of the present disclosure; and FIGS. 16 and 17 are elevational views illustrating actuation of the cinch disengage mechanism via the power cinch disengage actuator to shift the power closure latch assembly from its Secondary Latched mode into its Unlatched mode.

Corresponding reference numerals are used throughout the various views of the drawings to indicate corresponding components.

DETAILED DESCRIPTION

An example embodiment of a power closure latch assembly for use in a motor vehicle closure system will now be described more fully with reference to the accompanying drawings. To this end, the example embodiment of the power closure latch assembly is provided so that this disclosure will be thorough, and will fully convey its intended scope to those who are skilled in the art. Accordingly, numerous specific details are set forth such as examples of specific components, devices, and methods, to provide a thorough understanding of a particular embodiment of the present disclosure. However, it will be apparent to those skilled in the art that specific details need not be employed, that the example embodiment may be embodied in many different forms, and that the example embodiment should not be construed to limit the scope of the present disclosure. In some parts of the example embodiment, well-known processes, well-known device structures, and well-known technologies are not described in detail.

In the following detailed description, the expression "power closure latch assembly" will be used to generally indicate any power-operated latch device adapted for use with a vehicle closure panel to provide a power cinching feature with or without a power release feature. Additionally, the expression "closure panel" will be used to indicate any element mounted to a vehicle body portion of a motor vehicle and moveable between an open position and at least one closed position, respectively opening and closing an access to an inner compartment of the motor vehicle, and therefore includes, without limitations, decklids, tailgates, liftgates, bonnet lids, and sunroofs in addition to the sliding or pivoting passenger doors of the motor vehicle to which the following description will make explicit reference, purely by way of example.

Figure 1:
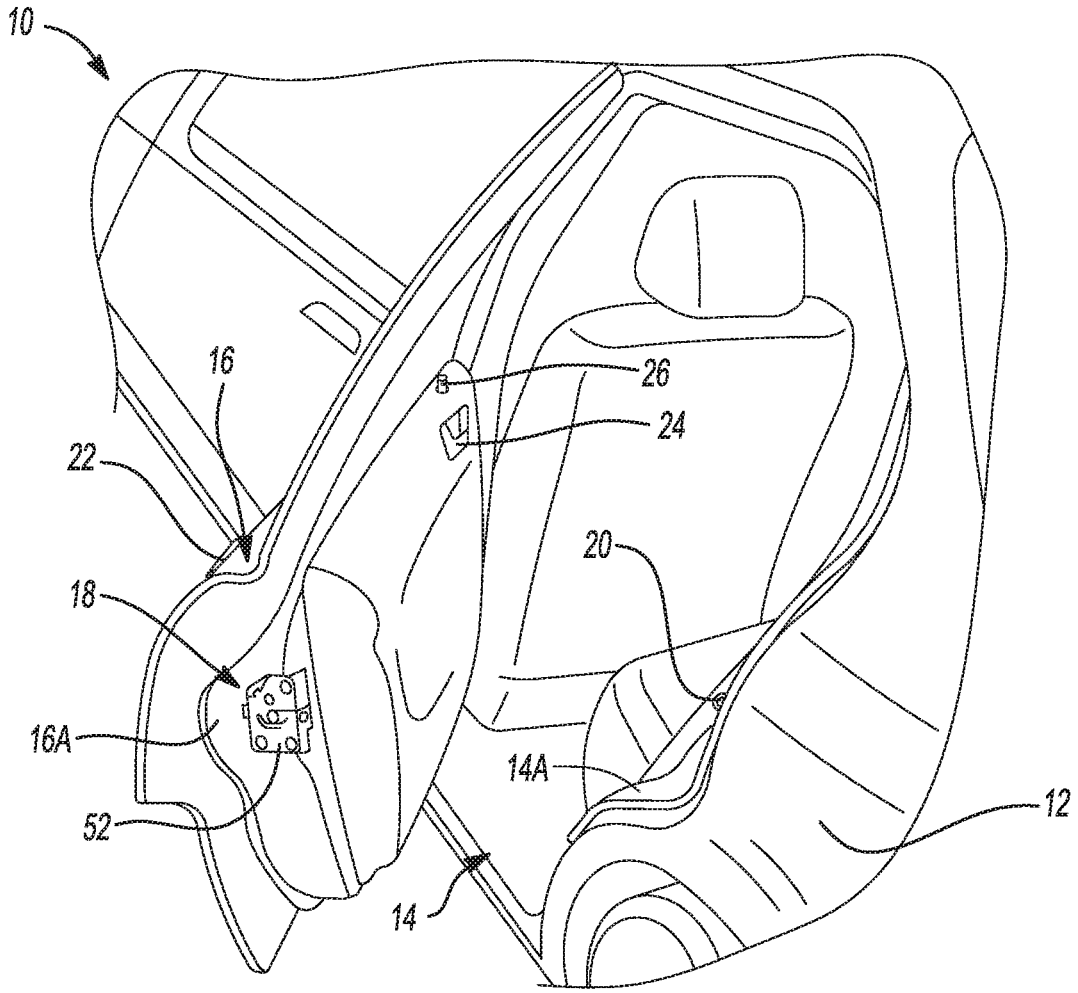
FIG. 1 is a partial perspective view of a motor vehicle having a closure panel equipped with a power closure latch assembly that is constructed in accordance with the teachings of the present disclosure.

Referring initially to FIG. 1 of the drawings, a motor vehicle 10 is shown to include a vehicle body 12 defining an opening 14 to an interior passenger compartment. A closure panel 16, for example a vehicle door 16, is illustratively shown pivotably mounted to vehicle body 12 for movement between an open position (shown) and a fully-closed position to respectively open and close opening 14. A power closure latch assembly 18 is shown secured to closure panel 16 adjacent to an edge portion 16A thereof and includes a latch mechanism that is releasably engageable with a striker 20 fixedly secured to a recessed edge portion 14A of opening 14. As will be detailed, power closure latch assembly 18 is operable to engage striker 20 and releaseably hold closure panel 16 in its fully-closed position. An outside handle 22 and an inside handle 24 are provided for selectively actuating a latch release mechanism of power closure latch assembly 18 to release striker 20 from the latch mechanism and permit subsequent movement of closure panel 16 to its open position. An optional lock knob 26 provides a visual indication of the locked state of closure latch assembly 18 and which may also be operable to mechanically change the locked state of closure latch assembly 18. A weather seal 28 is mounted on edge portion 14A of opening 14 in vehicle body 12 and is adapted to be resiliently compressed upon engagement with a mating sealing surface of closure panel 16 when closure panel 16 is held by the latch mechanism of closure latch assembly 18 in its fully-closed position so as to provide a sealed interface therebetween which is configured to prevent entry of rain and dirt into the passenger compartment while minimizing audible wind noise. For purpose of clarity and functional association with motor vehicle 10, the closure panel is hereinafter referred to as vehicle door 16.

A detailed description of a non-limiting example of power closure latch assembly 18, constructed in accordance with the teachings of the present disclosure, will now be provided. In general, power closure latch assembly 18 includes a latch mechanism 30, a latch release mechanism 32, a latch cinch mechanism 34, a power release actuator 36, a power cinch actuator 38, a cinch disengage mechanism 40, and a power cinch disengage actuator 42. While shown separately and schematically, it will be appreciated by those skilled in the art of vehicular closure latches that the specific functions provided by one or more of the above-noted power actuators (36, 38, 42) could be combined to provide coordinated actuation of any two or more of the noted mechanisms.

Figure 2:
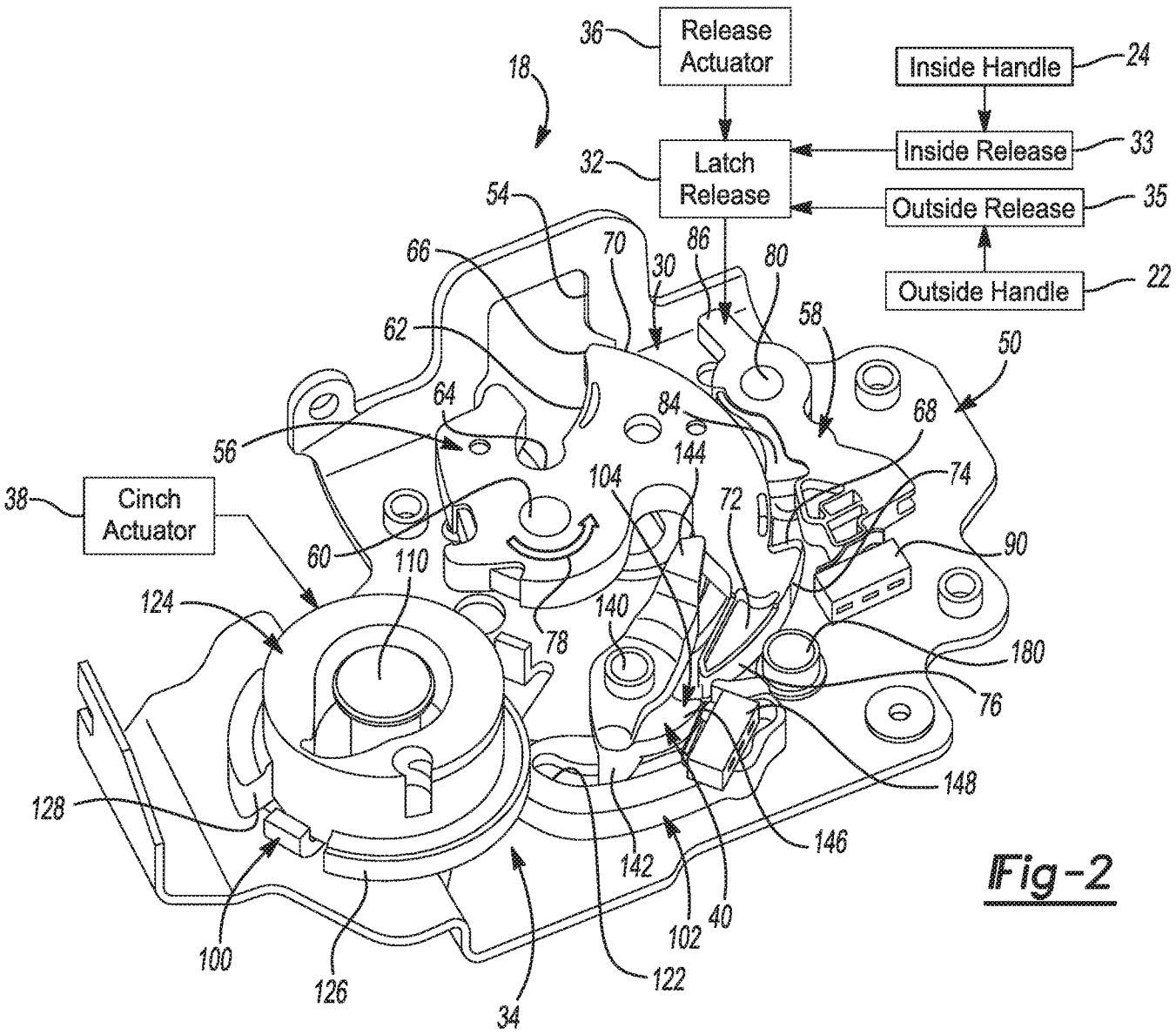
FIG. 2 is an isometric view of the power closure latch assembly of the present disclosure generally illustrating the components of a latch mechanism, a latch release mechanism, a power release actuator, a latch cinch mechanism, a power cinch actuator, and a cinch disengage mechanism with the power closure latch assembly operating in an Unlatched mode.
Figure 3:
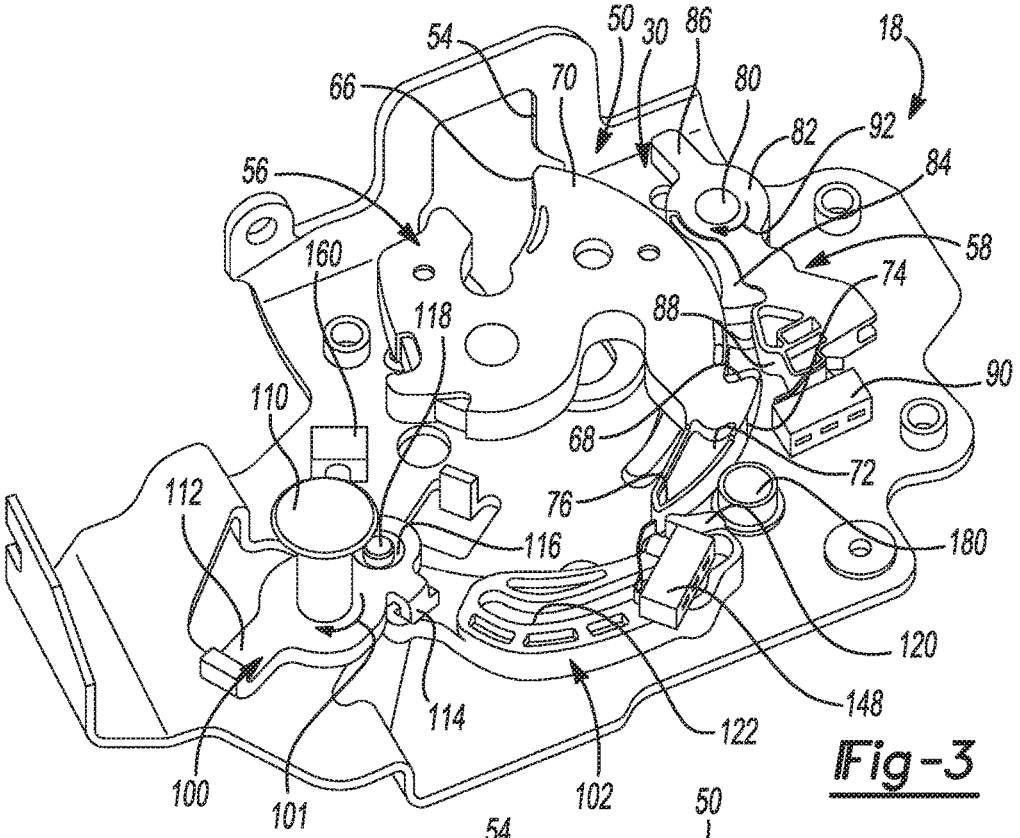
FIG. 3 is another isometric view of the power closure latch assembly shown in FIG. 2 with some components removed for additional clarity.
Figure 4:
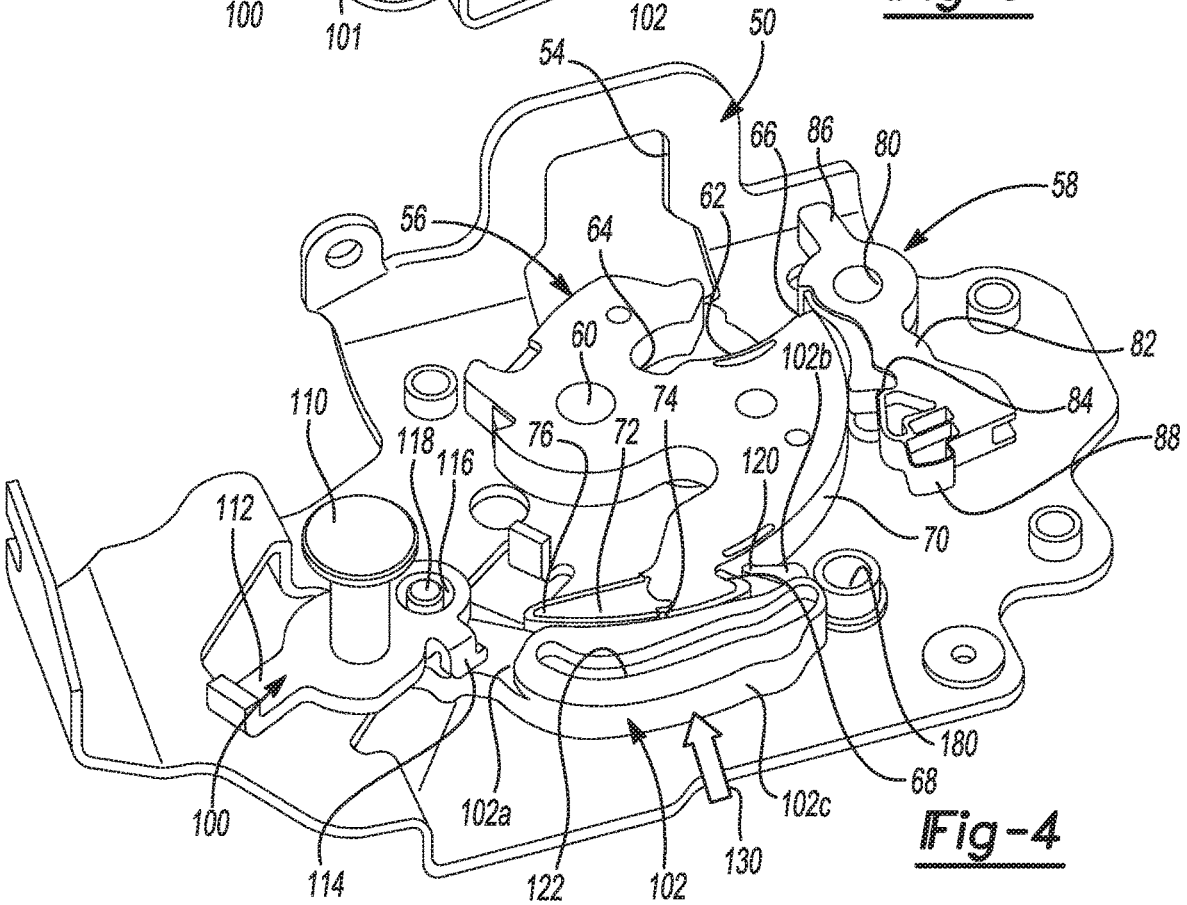
FIG. 4 is an isometric view of the power closure latch assembly shown in FIGS. 2 and 3 illustrating the components arranged to establish a Secondary Latched mode.
Figure 5A:
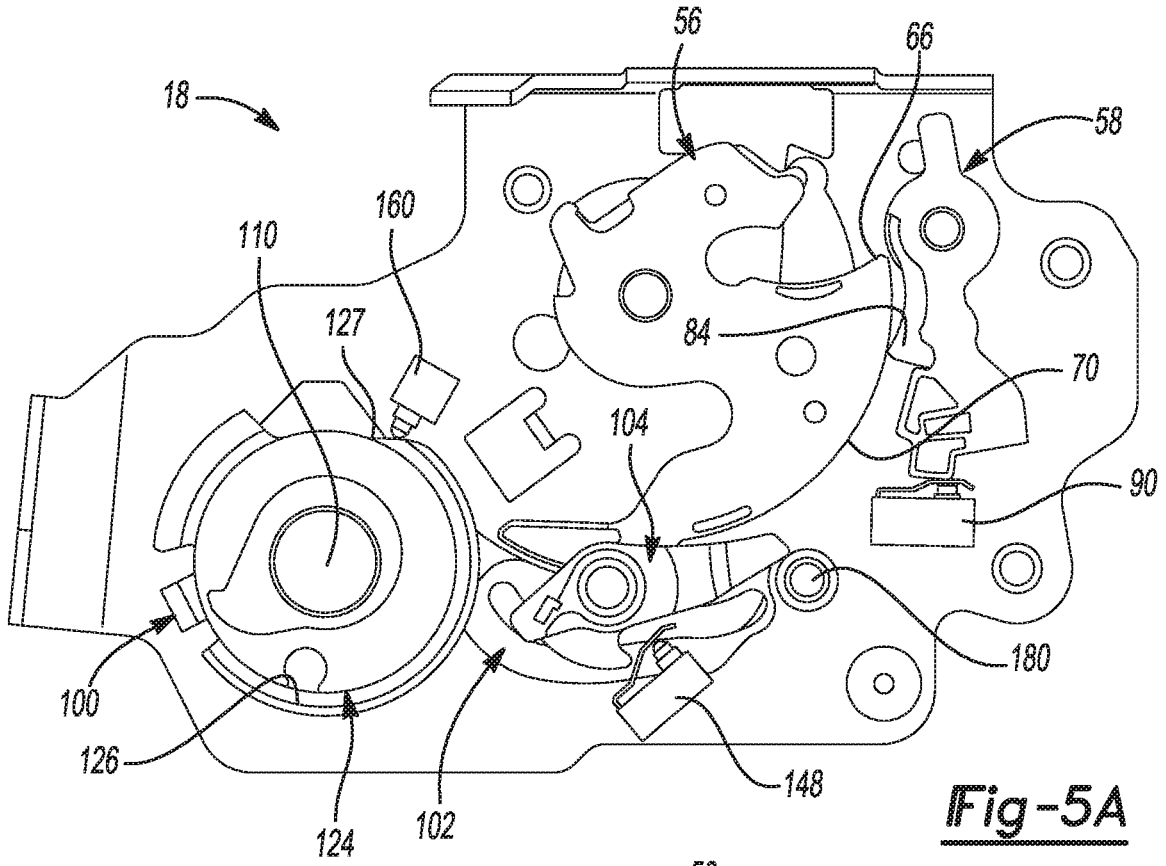
FIGS. 5A and 5B are elevational views of the power closure latch assembly of FIG. 4 operating in its Secondary Latched mode.
Figure 5B:
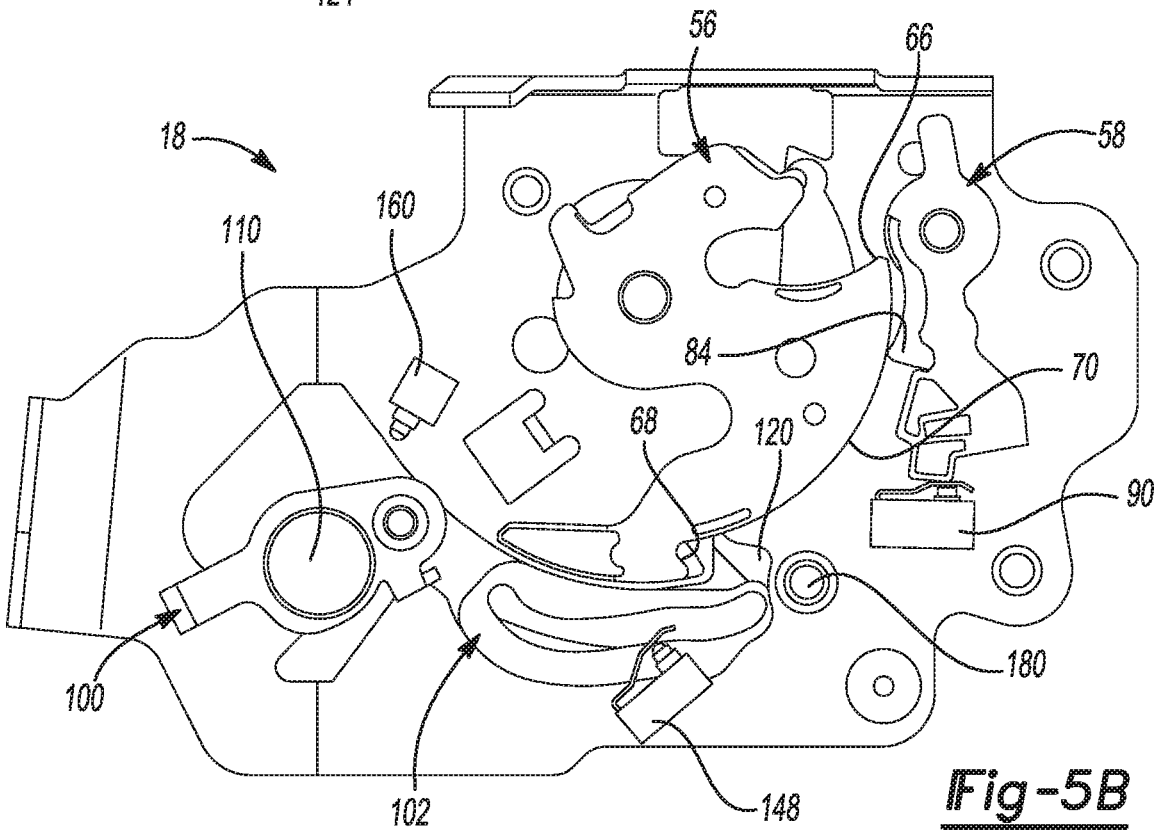
Figure 6A:
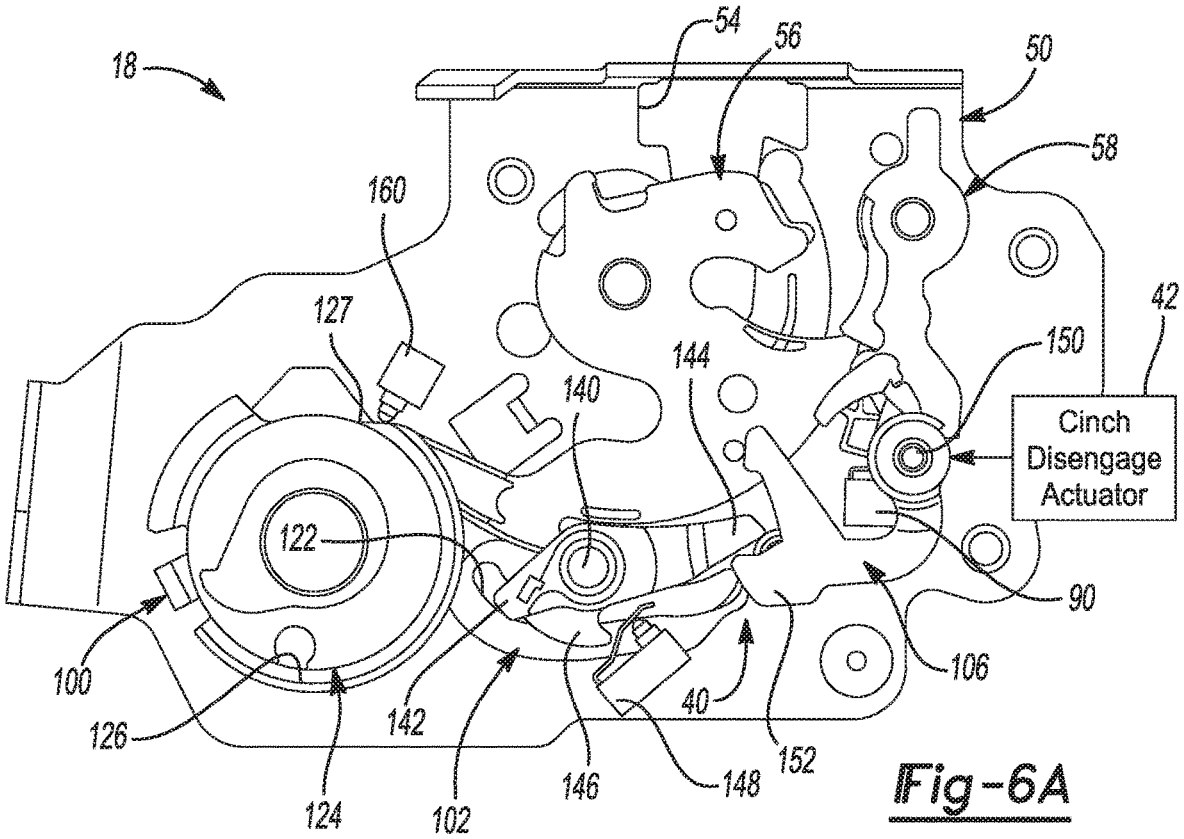
FIGS. 6A and 6B are elevational views, similar to FIGS. 5A and 5B respectively, but now illustrating the power closure latch assembly with its components located to establish a Primary Latched mode.
Figure 6B:
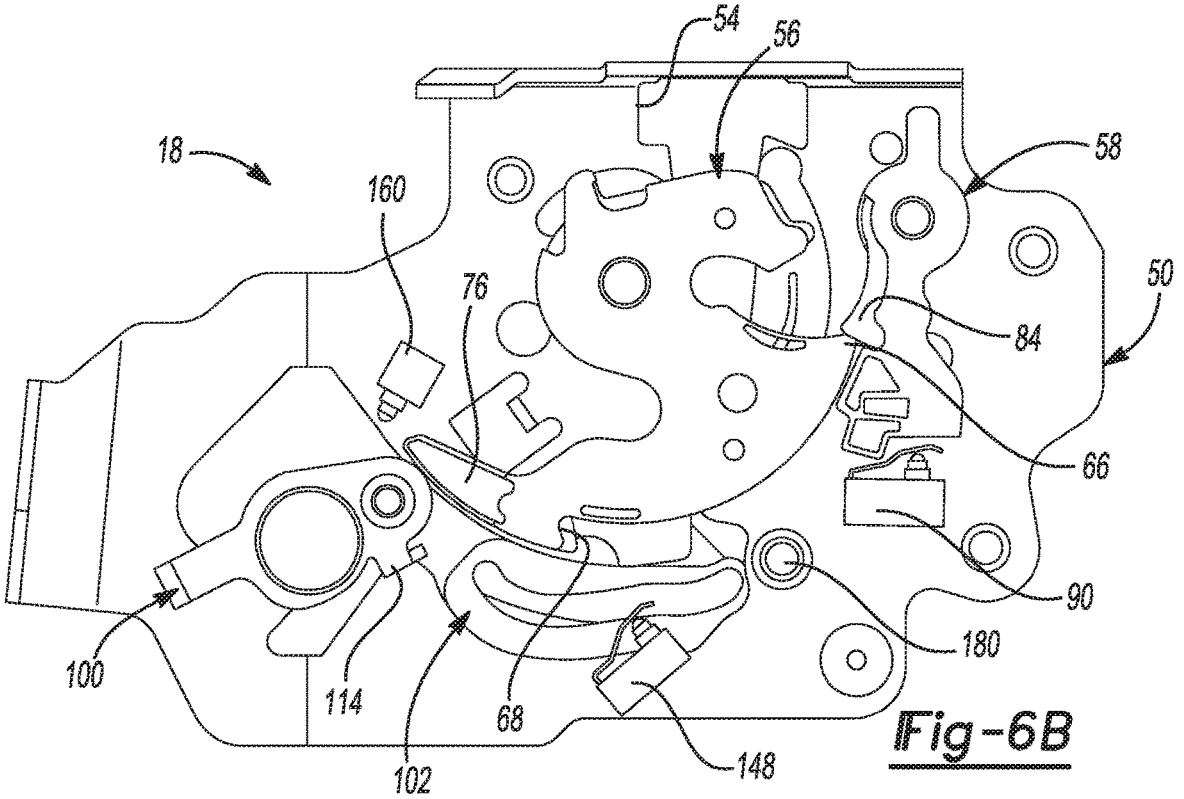
Figure 7:
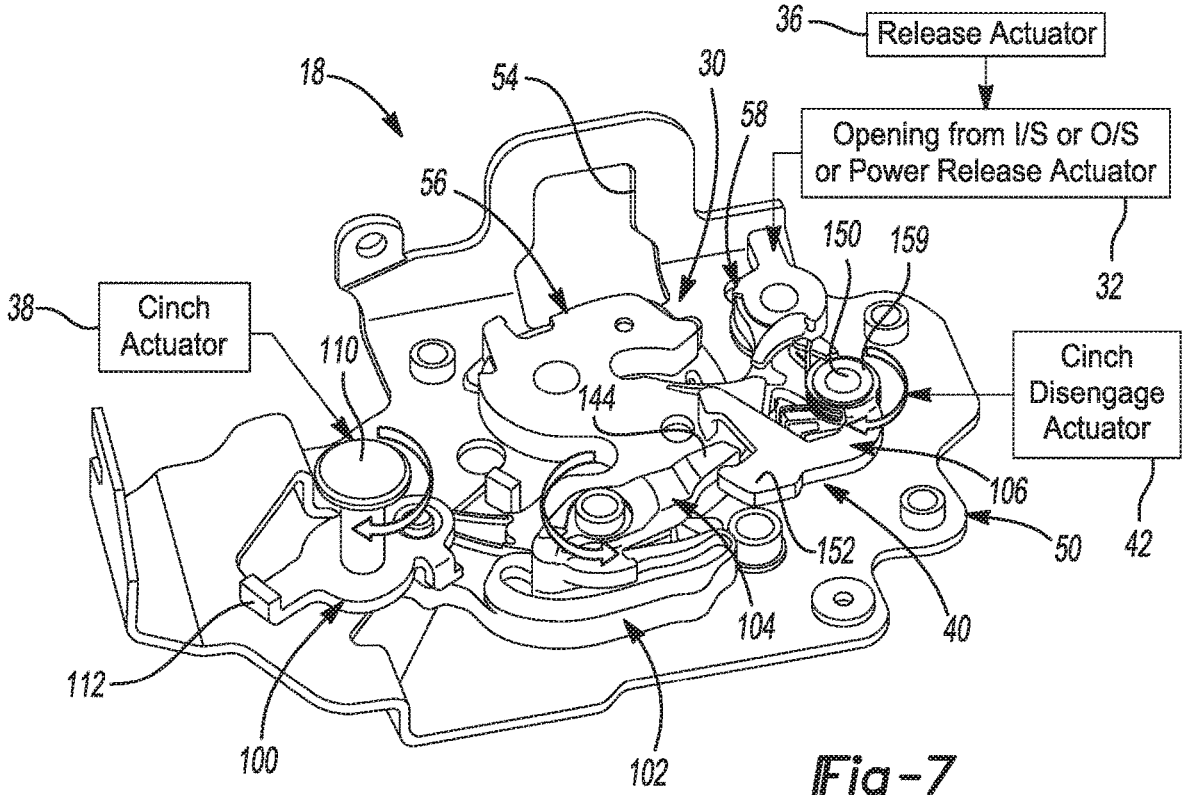
FIG. 7 is an isometric view of the power closure latch assembly shown in FIGS. 6A and 6B operating in its Primary Latched mode prior to actuation of the cinch disengage mechanism via a power cinch disengage actuator.
Figure 8:
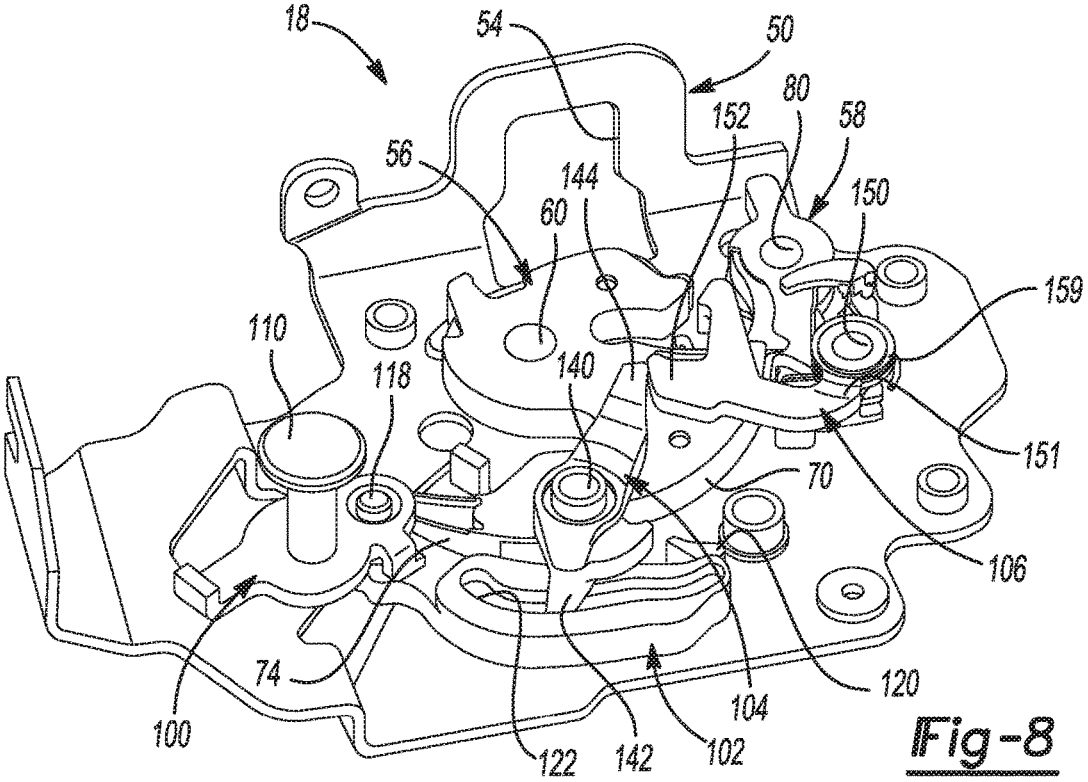
FIG. 8 is an isometric view, similar to FIG. 7, but now showing actuation of the cinch disengage mechanism via the power cinch disengage actuator prior to actuation of the latch release mechanism.

FIGS. 2 and 3 illustrate various components of power closure latch assembly 18 oriented and/or positioned to establish an Unlatched mode when vehicle door 16 is located in its open position with closure latch assembly 18 displaced from striker 20. FIGS. 4 and 5 illustrate various components of power closure latch assembly 18 oriented and/or positioned to establish a Latched-Uncinched or "Secondary Latched" mode when vehicle door 16 is located in a first or "soft closed" (i.e. partially-closed) position with striker 20 retained by latch mechanism 30. Finally, FIGS. 6-8 illustrate various components of power closure latch assembly 18 oriented and/or positioned to establish a Latched-Cinched or "Primary Latched" mode when vehicle door 16 is located in a second or "hard closed" (i.e. fully-closed) position with striker 20 retained by latch mechanism 30. As will be detailed hereinafter, movement of vehicle door 16 from its partially-closed position into its fully-closed position can be accomplished manually based on the closure force exerted by the vehicle operator thereon or, in the alternative, via a power-operated cinching operation configured to provide a "soft close" feature based on power cinch actuator 38 actuating latch cinch mechanism 34.

Referring initially to FIGS. 2 through 8, power closure latch assembly 18 is shown to include a frame plate 50 and a plate cover 52 (FIG. 1) supporting and enclosing the above-noted mechanisms and power actuators. Frame plate 50 is a rigid component configured to be fixedly secured to edge portion 16A of vehicle door 16 and which defines an entry aperture 54 through which striker 20 travels upon movement of vehicle door 16 relative to vehicle body 12. Latch mechanism 30 is shown, in this non-limiting example, as a single ratchet and pawl arrangement including a ratchet 56 and a pawl 58. Ratchet 56 is supported for rotational movement relative to frame plate 50 via a ratchet pivot pin 60. Ratchet 56 is configured to include a contoured guide channel 62 which terminates in a striker capture pocket 64, a closing notch 66, a cinching notch 68, and a first cam surface 70 extending between closing notch 66 and cinching notch 68. Ratchet 56 also is configured to include an arcuate extension 72 having a second cam surface 74 extending between a nose-shaped terminal end segment 76 and cinching notch 68. A ratchet biasing member, schematically shown by arrow 78, is adapted to normally bias ratchet 56 to rotate about ratchet pivot pin 60 in a first or "releasing" direction (i.e. counterclockwise in FIG. 2). Ratchet 56 is shown in FIG. 2 rotated to a striker release position with guide channel 62 generally aligned with entry aperture 54 in frame plate 50. As will be detailed, ratchet 56 is moveable through a range of motion between its striker release position, two distinct striker capture positions which include a secondary striker capture (i.e. the "soft closed") position and a primary striker capture (i.e. the "hard closed") position, and a ratchet overtravel position.

Pawl 58 is supported for rotational movement relative to a pawl pivot pin 80 extending from frame plate 50. Pawl 58 is configured to include a body segment 82 having a latch shoulder 84 that is adapted to ride against first cam surface 70 of ratchet 56 in response to movement of ratchet 56 between its secondary and primary striker capture positions. Latch shoulder 84 on pawl 58 is also configured to engage closing notch 66 when ratchet 56 is located in its primary striker capture position. Pawl 58 also includes a release lug segment 86 and a switch lug segment 88. Power release actuator 36 acts on, or is coupled to, release lug segment 86 of pawl 58 via latch release mechanism 32 and is operable to cause latch release mechanism 32 to selectively move pawl 58 between a ratchet releasing position and a ratchet holding position. A pawl switch 90 is mounted to frame plate 50 and is aligned with switch lug segment 88 of pawl 58 so as to provide a definitive pawl position signal when pawl 58 is located in its ratchet releasing position. A pawl biasing member, schematically illustrated by arrow 92, is provided for normally biasing pawl 58 in a first rotary direction (i.e. clockwise in FIG. 3) toward its ratchet holding position. Pawl 58 is shown in FIGS. 2-5 located in its ratchet releasing position and is shown in FIG. 6 located in its ratchet holding position.

Latch release mechanism 32, while only shown schematically, is understood by skilled artisans to be operable in a first or "non-actuated" state to locate pawl 58 in its ratchet holding position and in a second or "actuated" state to locate pawl 58 in its ratchet releasing position. Typically, latch release mechanism 32 is configured to be actuated by one or more manually-actuated release mechanisms in addition to power release actuator 36. For example, FIG. 2 schematically illustrates an inside release mechanism 33 arranged to interconnect inside handle 24 to latch release mechanism 32 so as to permit selective release of latch mechanism 30 via actuation of inside handle 24. Likewise, an outside release mechanism 35 is also schematically shown arranged to interconnect outside handle 22 to latch release mechanism 32 so as to permit selective release of latch mechanism 30 via actuation of outside handle 22. Power release actuator 36, while only schematically shown, is understood to include any type of power-operated device (i.e. electric motor, etc.) capable of actuation to provide a power release function.

As noted, power closure latch assembly 18 also includes latch cinch mechanism 34 controlled by power cinch actuator 38 as well as cinch disengage mechanism 40 controlled by power cinch disengage actuator 42. Latch cinch mechanism 34 generally includes a cinch lever 100 and a cinch link 102 while cinch disengage mechanism 40 generally includes a disengage lever 104 and an actuation lever 106. As will be detailed, cinch link 102 is operatively coupled to disengage lever 104 such that selective actuation of at least one of power cinch actuator 38 and power cinch disengage actuator 42 will cause coordinated movement of these two components. Again, while only shown schematically, power cinch actuator 38 and power cinch disengage actuator 42 are contemplated to be power-operated actuators, such as electric motors, to provide selective control over actuation of latch cinch mechanism 34 and/or cinch disengage mechanism 40.

Cinch lever 100 is shown to be rotatably mounted to frame plate 50 via a cinch lever pivot pin 110. Cinch lever 100 is configured to include a drive lug 112, a stop lug 114, and a pivot aperture 116. As will be detailed, cinch lever 100 is rotatable relative to pivot pin 110 between a first or "cinch start" position and a second or "cinch stop" position. A cinch lever biasing member, schematically indicated by arrow 101, biases cinch lever 100 toward its cinch start position. Cinch link 102 is an elongated component having a first end segment 102A, a second end segment 102B, and an intermediate segment 102C therebetween. First end segment 102A of cinch link 102 has an upstanding cinch link pivot pin 118 which is pivotably retained within pivot aperture 116 in cinch lever 100. As will be detailed, cinch link 102 is supported for pivotal movement relative to cinch lever 100 about pivot pin 118 between a first or "cinch link engaged" position and a second or "cinch link disengaged" position. Second end segment 102B of cinch link 102 has a drive lug 120 configured to slide against (or be in close proximity to) second cam surface 74 on ratchet 56 in response to movement of ratchet 56 from its striker release position toward its secondary striker capture position. Additionally, drive lug 120 on cinch link 102 is also configured to lockingly engage cinching notch 68 on ratchet 56 when ratchet 56 is located in its secondary striker capture position and cinch link 102 is located in its cinch link engaged position. Finally, drive lug 120 is configured to forcibly rotate ratchet 56 from its secondary striker capture position through its primary striker capture position and into its ratchet overtravel position in response to actuation of latch cinch mechanism 34 to provide the "soft close" power cinching function. Intermediate segment 102C of cinch link 102 includes an elongated, contoured guide slot 122.

A cinch pulley 124 is rotatably mounted on cinch lever pivot pin 110 and includes a peripheral flange 126 defining a notch 127 and an opening 128 within which drive lug 112 of cinch lever 100 is retained. As a result of this arrangement, rotation of cinch pulley 124 in a cinching (i.e. counterclockwise) direction via controlled actuation of power cinch actuator 38 will result in rotation of cinch lever 100 between its cinch start position (FIGS. 13A-13B) and its cinch stop position (FIGS. 14A-14B). Stop lug 114 interacts with a stop projection (not shown) formed on frame plate 50 (latch housing) to positively locate cinch lever 100 in its cinch start position. Due to the connection between cinch lever 100 and cinch link 102, via cinch link pivot pin 118 being seated within aperture 116, cinch link 102 is located in a first or "uncinched" position when cinch lever 100 is located in its cinch start position and cinch link 102 is located in a second or "cinched" position when cinch lever 100 is located in its cinch stop position. As will be detailed, cinch disengage mechanism 40 is operable for pivoting cinch link 102 (when located in its uncinched position) between its cinch link engaged position (FIGS. 7 and 16) and its cinch link disengaged position (FIGS. 8 and 17). Arrow 130 (FIG. 4) indicates a cinch link biasing member configured to apply a biasing force on cinch link 102 for normally biasing cinch link 102 in an engaging direction (i.e. counterclockwise in FIG. 4) toward its cinch link engaged position.

Cinch link 102 is shown in FIG. 16 in its cinch link engaged position with its drive lug 120 engaged with cinching notch 68 for mechanically holding ratchet 56 in its secondary striker capture position while pawl 58 is maintained in its ratchet releasing position with its latch shoulder 84 biased via pawl biasing member 92 into engagement with first cam surface 70 on ratchet 56. In contrast, FIG. 17, illustrates cinch link 102 pivoted to its cinch link disengaged position due to power cinch disengage actuator 42 actuating cinch disengage mechanism 40. In this position, ratchet 56 is free to rotate from its secondary striker capture position toward its striker released position since pawl 58 is located in its ratchet releasing position. In addition, FIGS. 7 and 8 illustrate actuation of cinch disengage mechanism 40 via power cinch disengage actuator 42 causing cinch link 102 to move from its cinch link engaged position into its cinch link disengaged position while ratchet 56 is located and held in its primary striker capture position by pawl 58. Note that pawl 58 is located in its ratchet holding position with latch shoulder 84 engaging closing notch 66 on ratchet 56 such that cinch link 102 does not function to mechanically engage and hold ratchet 56. A subsequent release of latch release mechanism 32 facilitates the release of ratchet 56 for movement to its striker release position. Thus, latch cinch mechanism 34 is used to hold ratchet 56 in its secondary capture position while latch mechanism 30 is used to hold ratchet 56 in its primary striker capture position.

Disengage lever 104 is rotatably mounted to frame plate 50 via a disengage lever pivot pin 140 and is configured to include a follower lug 142 that is retained in guide slot 122 of cinch link 102, an actuation lug 144, and a switch lug segment 146. A disengage lever switch 148 is mounted to frame 50 and is oriented to provide a definitive disengage lever position signal regarding the position of disengage lever 104. Actuation lever 106 is configured to include a body segment 151 rotatably mounted to frame 50 via an actuation lever pivot pin 150, and an engagement lug 152 arranged to selectively act on actuation lug 144 of disengage lever 104. Cinch disengage mechanism 40 is shown in FIG. 7 operating in a Non-Actuated state and is shown in FIG. 8 operating in an Actuated state. Specifically, with cinch disengage mechanism 40 in its Non-Actuated state, disengage lever 104 is located in a first or "non-actuated" position and actuation lever 106 is located in a first or "home" position. With disengage lever 104 located in its non-actuated position (FIG. 7), the interaction between follower lug 142 and contoured guide slot 122 acts to locate cinch link 102 in its cinch link engaged position while allowing cinch link 102 to move between its uncinched position and its cinched position. As cinch link 102 moves between its uncinched position (see FIG. 13B for example) and its cinched position (see FIG. 13A for example), follower lug 142 will be maintained in engagement with cinch link 102 by contoured guide slot 122 without restricting the cinching movement of cinch link 102 between its uncinched position and its cinched position. However, actuation of power cinch disengage actuator 42 functions to rotate actuation lever 106 about pivot pin 150 from its home position to a second or "engaged" position (FIG. 8), thereby causing engagement lug 152 to engage actuation lug 144 on disengage lever 104 and forcibly pivot disengage lever 104 about pivot pin 140 from its non-actuated position into its actuated position. This pivotal movement of disengage lever 104 from its non-actuated position to its actuated position causes cinch link 102 to pivot about pivot pin 118 from its cinch link engaged position to its cinch link disengaged position due to the interaction of follower lug 142 within guide slot 122. A biasing spring 159 acts to normally bias actuation lever 106 toward its home (counterclockwise in FIG. 7).

As a result of the interaction between follower lug 142 and contoured guide slot 122, the movement of disengage lever 104 from its non-actuated position into its actuated position can cause cinch link 102 to pivot about pivot pin 118 from its cinch link engaged position to its cinch link disengaged position at any point at, or between, its cinched position and its uncinched position. Therefore, at any point during the movement of ratchet 56 between the secondary and primary striker positions caused by the cinching action of the cinch link 102 moving between its uncinched position and its cinched position (and before pawl 58 has moved into its ratchet holding position whereat pawl 58 is positioned to hold ratchet 56 in its primary striker position), cinch link 102 can be moved from its cinch link engaged position to its cinch link disengaged position, for example by a manual movement of cinch link 102, or by a powered movement of cinch link 102. Having the possibility to override latch cinch mechanism 34 (that is being able to move the cinch link 102 from its cinch link engaged position to its cinch link disengaged position at any point during the cinching action of latch cinch mechanism 34) either by mechanical operation (e.g. a user physical activating a lever operably connected thereto) or electrical operation (e.g. a user activating an electric switch causing a power release function via an electric motor operably connected to cinch link 102) will allow ratchet 56 to move to its striker release position whereat ratchet 56 is positioned to release striker 20 due to cinch link 102 no longer restricting its movement (therefore allowing vehicle door 16 to be open notwithstanding the position of ratchet 56 between its primary and secondary striker capture positions). Also, this override capability prevents, for example in the event of a latch cinch mechanism 34 malfunction (e.g. a loss of power, a motor malfunction, etc.) during a cinching action, ratchet 56 from being held by cinch link 102 in its cinch link engaged position between its primary and secondary striker capture positions preventing release of striker 20 therefrom, and allows ratchet 56 to move to allow release of striker 20 by the disengagement of cinch link 102 from ratchet 56.

As noted, FIGS. 2 and 3 illustrate the arrangement of components when power closure latch assembly 18 is operating in its Unlatched mode with ratchet 56 rotated to its striker release position and pawl 58 maintained in its ratchet releasing position. As seen, pawl biasing member 92 biases latch shoulder 84 on pawl 58 into engagement with first cam surface 70 on ratchet 56 so as to hold pawl 58 in its ratchet releasing position.

FIG. 4 illustrates power closure latch assembly 18 operating in its Secondary Latched mode with ratchet 56 held in its secondary striker capture position by cinch link 102 being located in its cinch link engaged position while pawl 58 is still maintained in its ratchet releasing position. Movement of ratchet 56 from its striker release position into its secondary striker capture position results from vehicle door 16 being moved into its partially-closed position.

FIGS. 5A, 5B and FIGS. 6A, 6B illustrate ratchet 56 being forcibly moved from its secondary striker capture position into its primary striker capture position and pawl 58 being permitted to move into its ratchet holding position in response to closure of vehicle door 16 to its fully-closed position without the need of a power cinching operation, thereby defining the Primary Latched mode of power closure latch assembly 18. Such movement of vehicle door 16 to its fully-closed position causes striker 20 to rotate ratchet 56 to its ratchet overtravel position whereat pawl biasing member 92 moves pawl 58 into its ratchet holding position and ratchet biasing member 78 subsequently drives ratchet 56 back to its primary striker capture position with its closing notch 66 engaging latch shoulder 84 on pawl 58. Note that cinch lever 100 is maintained in its cinch start position and cinch link 102 is maintained in its cinch link engaged position during this typical manual door closure activity.

FIGS. 7 and 8 illustrate actuation of cinch disengage mechanism 40 via power cinch disengage actuator 42 to move cinch link 102 from its cinch link engaged position to its cinch link disengaged position while cinch lever 100 is maintained in its cinch start position and prior to movement of pawl 58 to its ratchet releasing position via actuation of latch release mechanism 32.

Figure 9:
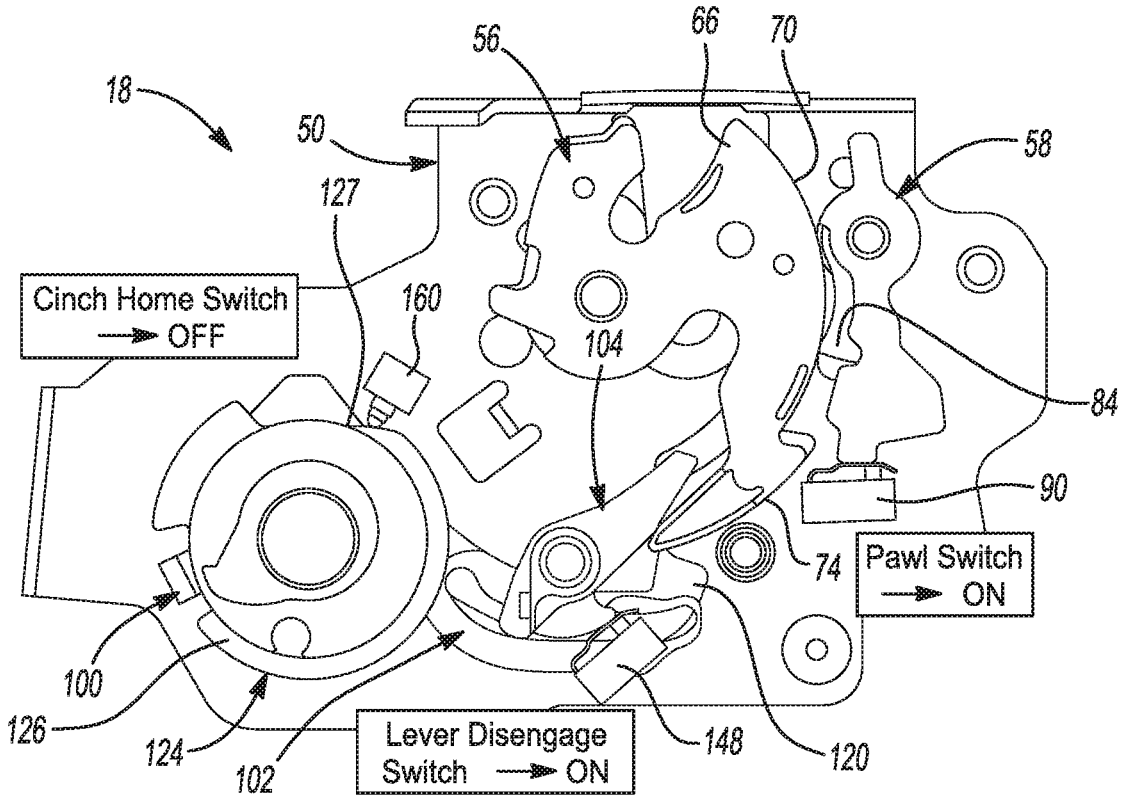
FIGS. 9 through 12 are elevational views sequentially illustrating the shifting of the power closure latch assembly from its Unlatched mode through its Secondary Latched mode into its Primary Latched mode in response to movement of the closure panel from an open position into a fully-closed position.

Referring to FIG. 9, closure latch assembly 18 is shown in its Unlatched mode with pawl switch 90 detecting and signaling the location of pawl 58 in its ratchet releasing position, disengage lever switch 148 detecting and signaling location of disengage lever 104 in its actuated position (indicative of cinch link 102 being located in its cinch link disengaged position), while a cinch home switch 160 detects and signals that cinch lever 100 is not located in its cinch home position (via cinch pulley 124 also being in its home position i.e peripheral flange 126 not being in contact with cinch home switch 160 via alignment with notch 127). Basically, switch lug segment 88 on pawl 58 activates (ON) pawl switch 90, switch lug segment 146 on disengage lever 104 activates (ON) disengage lever switch 148, and notch 127 on peripheral flange 126 does not activate (OFF) cinch home switch 160. Note that latch shoulder 84 on pawl 58 engages first cam surface 70 on ratchet 56 for mechanically holding pawl 58 in its ratchet releasing position when ratchet 56 is located in its striker release position. Note also that drive lug 120 on cinch link 102 engages second cam surface 74 on ratchet 56 for mechanically holding cinch link 102 in its cinch link disengaged position. Additionally, the interaction between guide slot 122 in cinch link 102 and follower lug 142 on disengage lever 104 causes disengage lever 104 to be held in its actuated position when cinch link 102 is held in its cinch link disengaged position.

Figure 10:
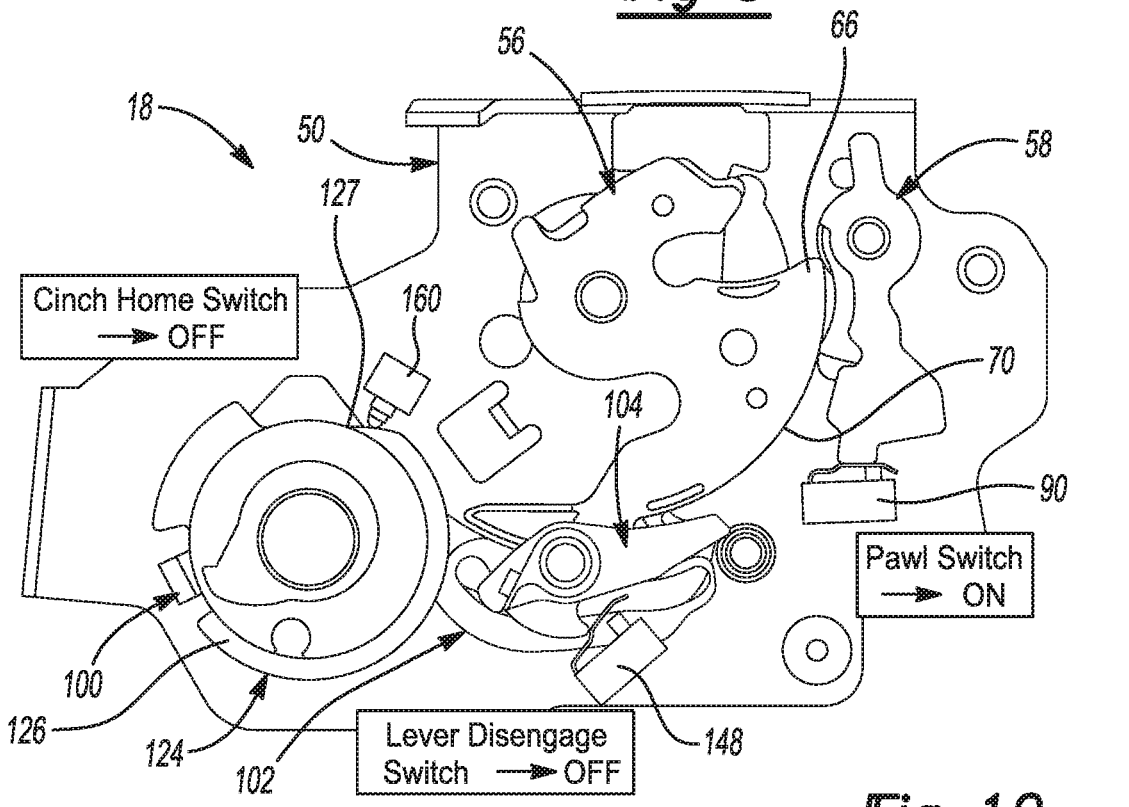
Figure 11:
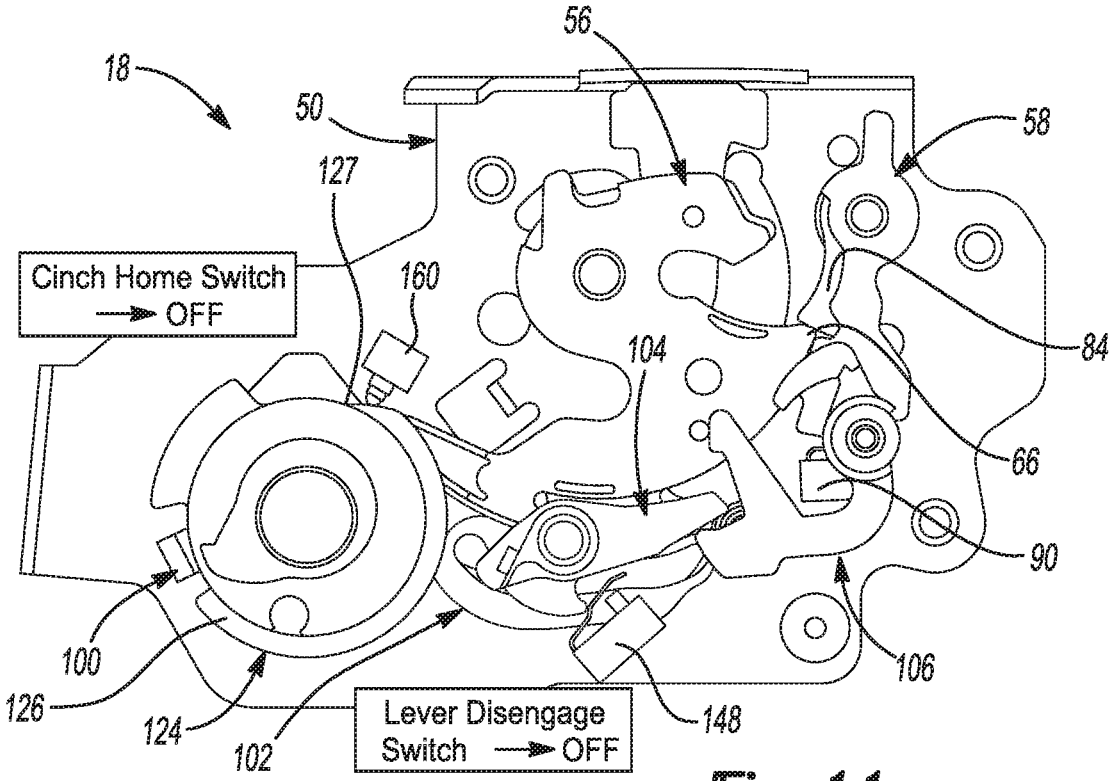
Figure 12:
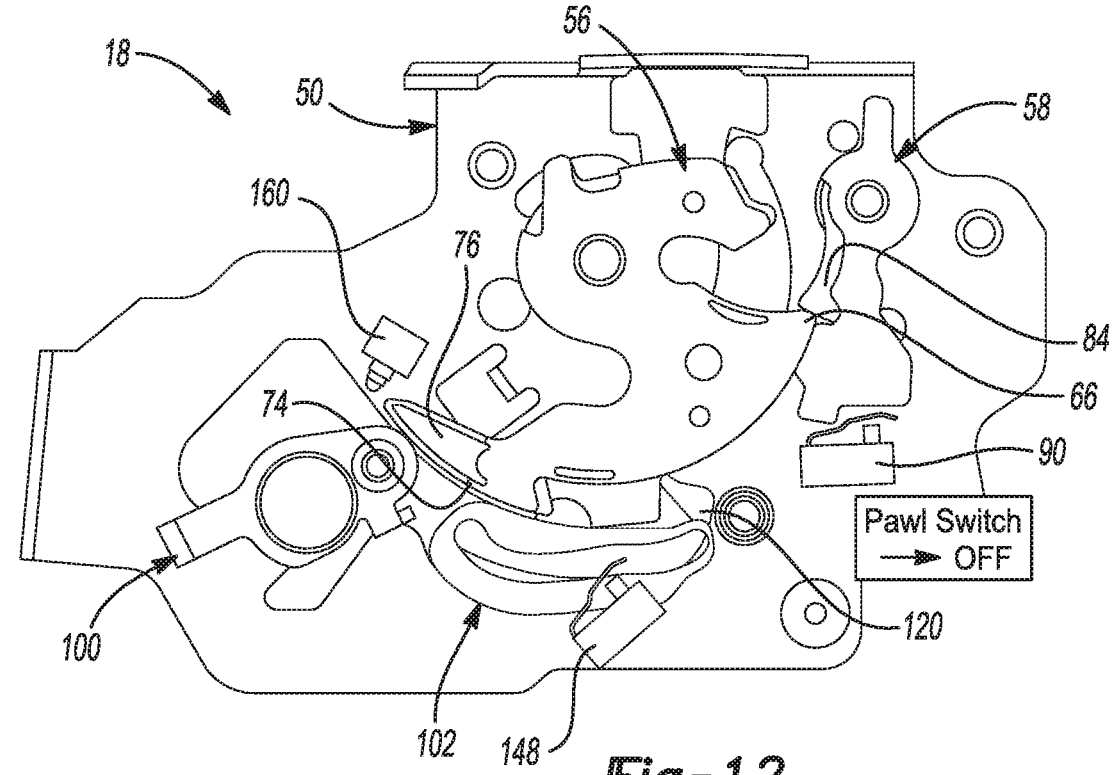

Referring next to FIG. 10, initial movement of vehicle door 16 toward its closed positions now results in striker 20 causing movement of ratchet 56 from its striker release position to its secondary striker capture position. As such, power closure latch assembly 18 is now shown in its Secondary Latched mode with pawl switch 90 continuing to signal the location of pawl 58 in its ratchet releasing position and cinch home switch 160 continuing to signal that cinch link 102 is still located in its home position or cinch start position. However, now disengage lever switch 148 has been de-activated (OFF) since disengage lever 104 has moved from its actuated position into its non-actuated position (which is indicative of cinch link 102 being moved in its cinch link engaged position). Thus, disengage lever switch 148 changes status exactly as ratchet 56 moves into its secondary striker capture position as caused by cinch link biasing member represented by arrow 130 configured to apply the biasing force acting on cinch link 102 to move cinch link 102 into engagement with ratchet 56. FIGS. 11 and 12 illustrate continued movement of ratchet 56 by striker 20 to its primary striker capture position and pawl 58 being moved to its ratchet holding position. As such, the status of pawl switch 90 changes from activated (ON) to de-activated (OFF) to indicate movement of pawl 58 into its ratchet holding position while the status of disengage lever switch 148 remains OFF and cinch home switch 160 remains OFF. Note that latch shoulder 84 on pawl 58 is engaging closing notch 66 on ratchet 56 such that pawl 58, in its ratchet holding position, functions to mechanically hold ratchet 56 in its primary striker capture position. Also note that cinch link 102 is located in its cinch link engaged position such that drive lug 120 now rides along first cam surface 70 on ratchet 56. Actuation of cinch disengage mechanism 40 as previously disclosed with reference to FIGS. 7 and 8, is now required to move cinch link 102 to its cinch link disengaged position to allow subsequent rotation of ratchet 56 to its striker release position when closure latch assembly 18 is subsequently shifted into its Unlatched mode via activation of latch release mechanism 32.

Figure 13A:
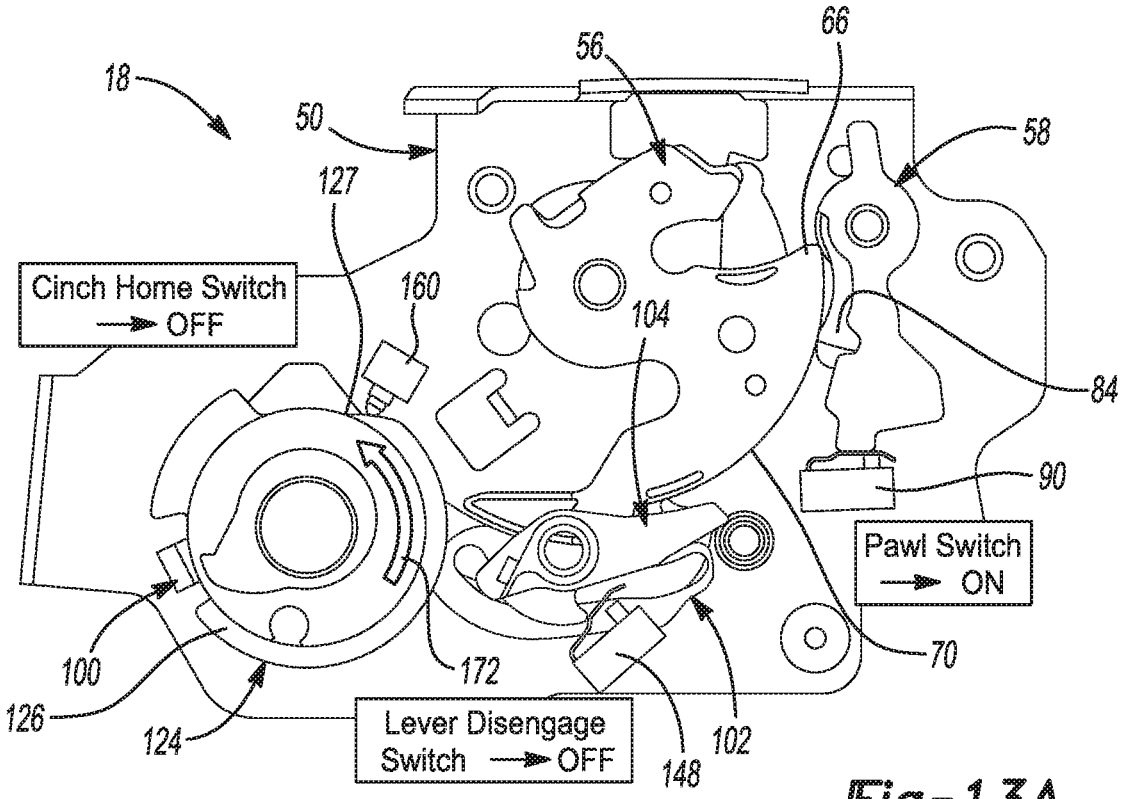
Figure 13B:
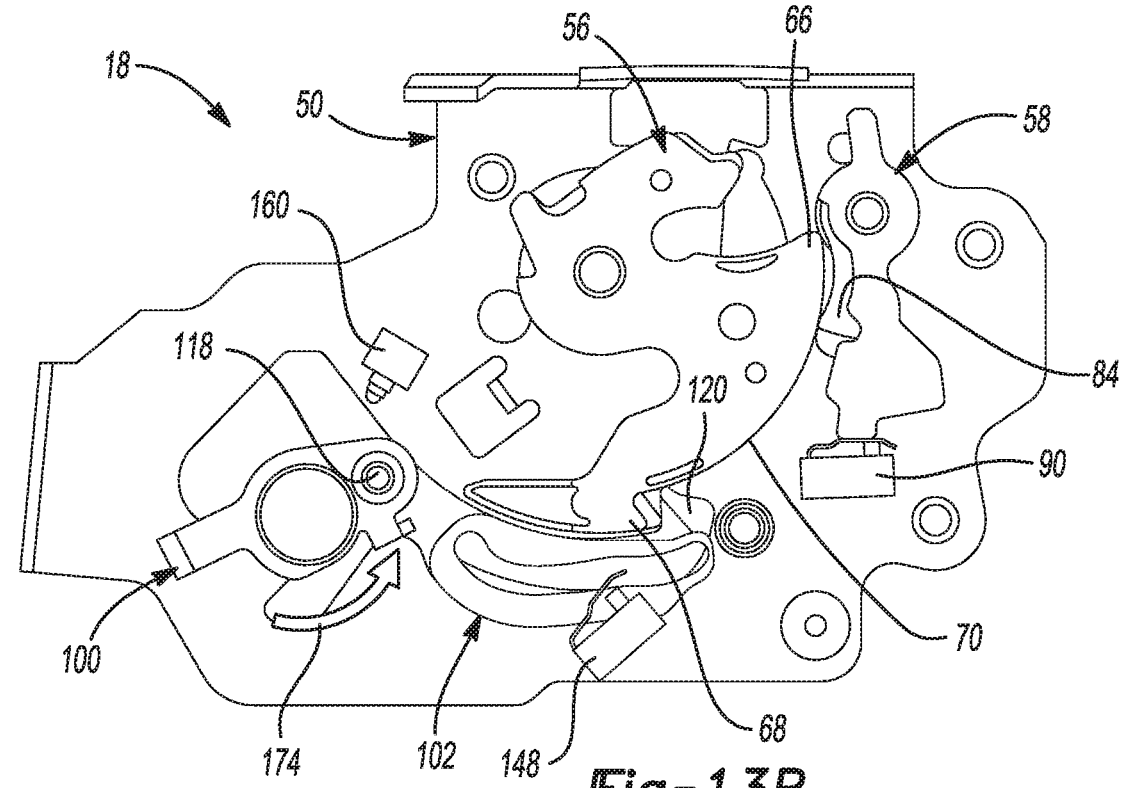
Figure 14A:
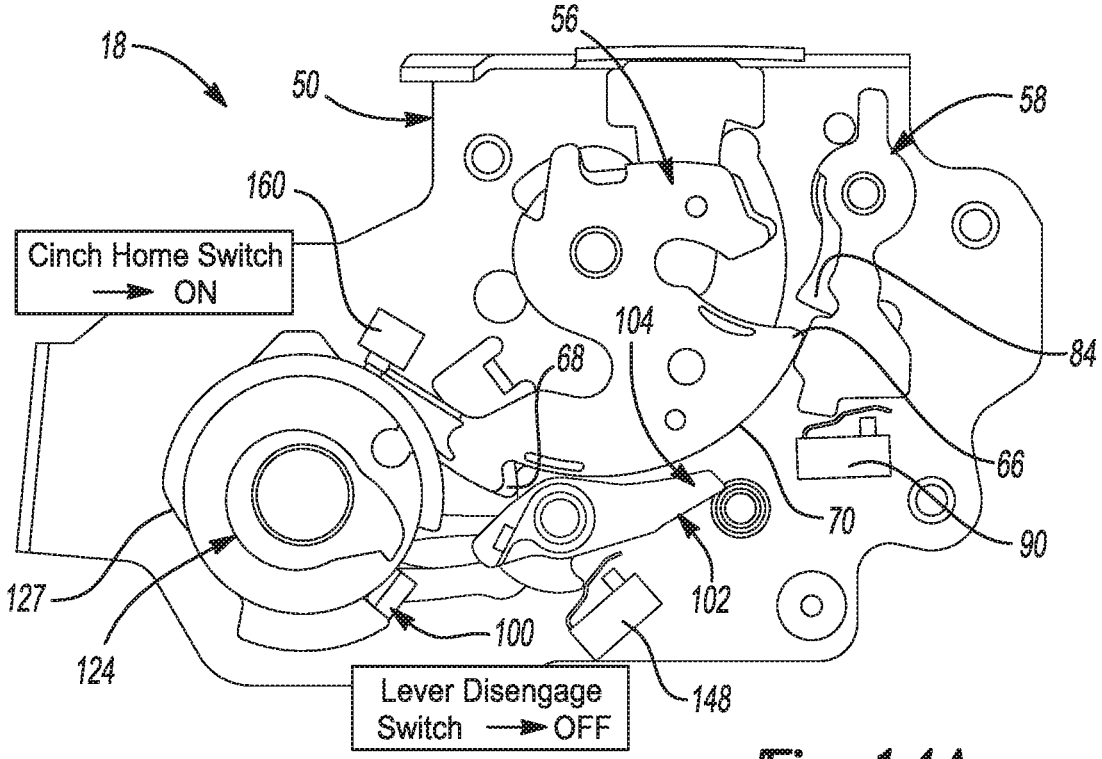
Figure 14B:
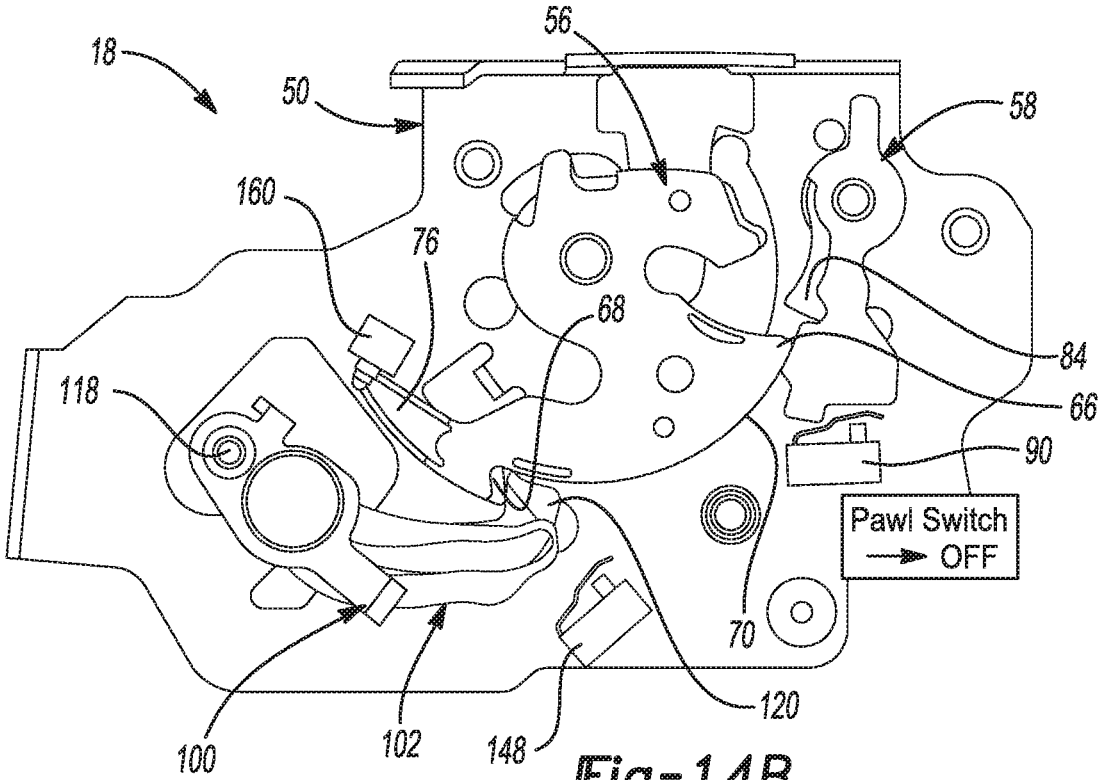
Figure 15A:
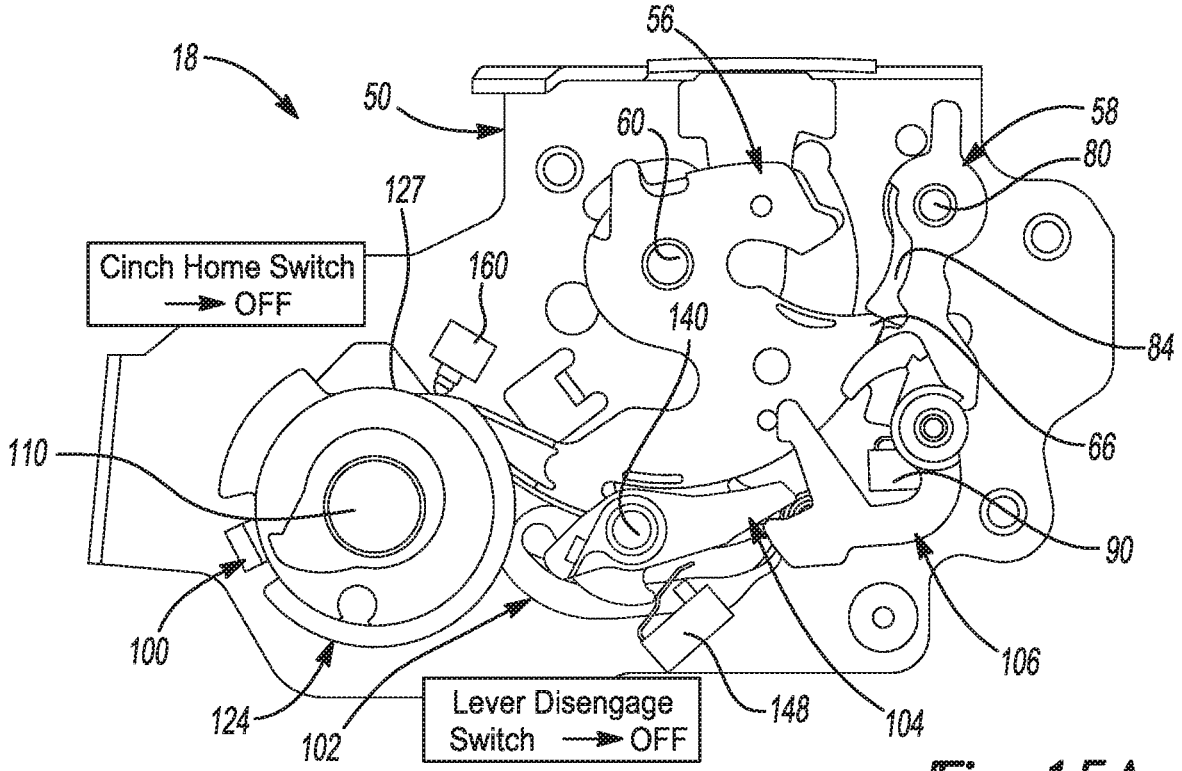
Figure 15B:
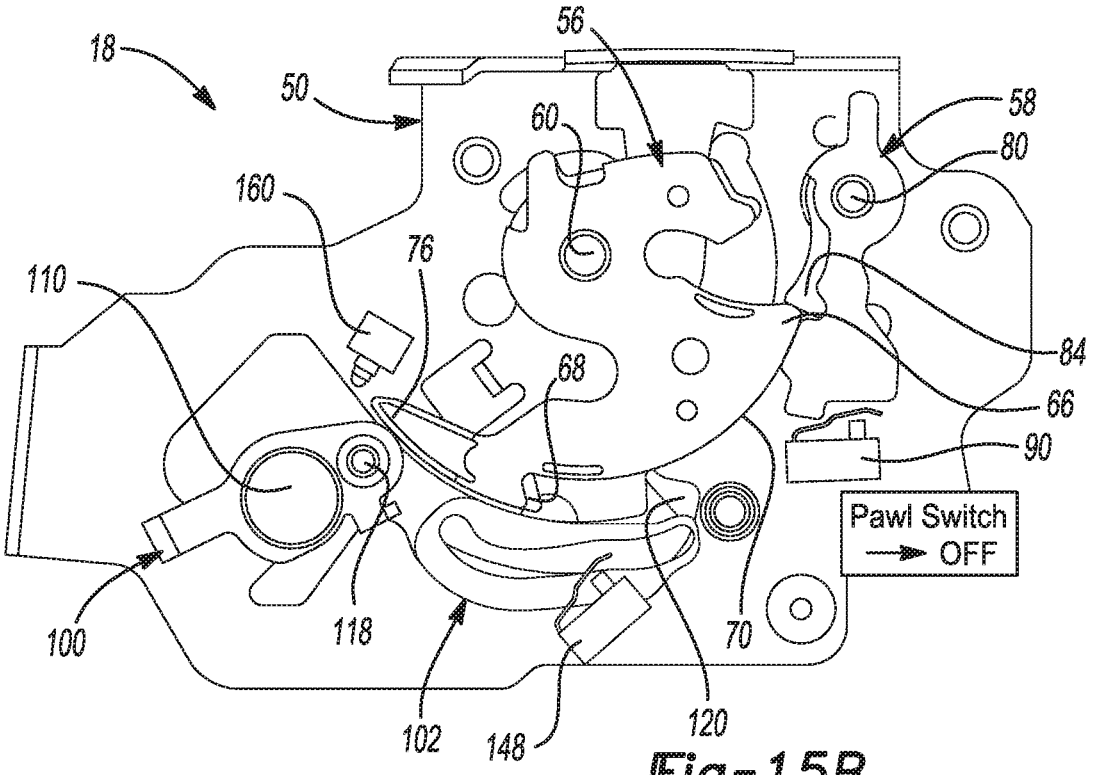

Referring now to FIGS. 13-15, the power cinching feature provided by power closure latch assembly 18 will be detailed. Specifically, FIGS. 13A and 13B illustrate initiation of the power cinching process which occurs upon ratchet 56 being moved by striker 20 into its secondary striker capture position and the movement of cinch link 102 into its cinch link engaged position. As noted, in this condition, drive lug 120 on second end segment 102B of cinch link 102 engages cinching notch 68 on ratchet 56. Upon disengage lever switch 148 detecting this change in status (movement of disengage lever 104 from its actuated position to its non-actuated position), power cinch actuator 38 is actuated to rotate cinch pulley 124 in a cinching direction (arrow 172) which, in turn, rotates cinch lever 100 in a common cinching direction (arrow 174). This rotation of cinch lever 100 about cinch lever pivot pin 110 from its cinch start position toward its cinch stop position causes cinch link 102 to move from is uncinched position toward its cinched position (while being maintained in its cinch link engaged position) due to retention of pivot pin 118 on cinch link 102 within pivot aperture 116 in cinch lever 100. Such movement of cinch link 102 results in cinch link 102 forcibly rotating ratchet 56 from its secondary striker capture position to a position past its primary striker capture position, referred to as its ratchet overtravel position (FIGS. 14A and 14B).

Once ratchet 56 has reached its primary striker position, which may include its ratchet overtravel position due to a continued operation of the cinch actuator 38 as a result of a timed operation to ensure the pawl 58 has properly engaged ratchet 56, the status of pawl switch 90 is switched from (ON) to (OFF) in response to corresponding biased movement of pawl 58 into its ratchet holding position. The signal generated by pawl switch 90 is used by a controller or control unit for example (both not shown) to cause cinch actuator 38 to stop its operation and thus stop the cinching movement of cinch link 102. Thereafter, power cinch actuator 38 is reversed for moving cinch lever 100 from its cinch stop position of FIGS. 14A and 14B back to its cinch start position of FIGS. 15A and 15B until the imparted reversed rotation (i.e. cinch pulley 124 rotation in the direction schematically indicated by arrow 101 towards its cinch start position as imparted by cinch actuator 38 thereon) causes peripheral flange 126 to reach a radial orientation with notch 127 whereat cinch home switch 160 is disengaged from peripheral flange 126 causing the status of cinch home switch 160 to be switched from (ON) to (OFF), indicating cinch link 102 has reached its home position, or uncinched position. Thus, latch cinch mechanism 34 is reset into its Cinch Homing State. This resetting of latch cinch mechanism 34 also permits ratchet biasing member 78 to drive ratchet 56 from its ratchet overtravel position into its primary striker capture position. It is also noted that power closure latch assembly 18 includes a retention pin 180 mounted to frame plate 50 in proximity to second end segment 102B of cinch link 102. Retention pin 180 provides a hard stop to cinch link 102 in the event of a collision incident.

It will be appreciated that cinch disengage mechanism 40 can be actuated when closure latch assembly 18 is in either of its Latched modes and immediately prior to actuation of latch release mechanism 32 so as to permit closure latch assembly 18 to be shifted into its Unlatched mode. Those skilled in the art will also appreciate that closure latch assembly 18 can include a suitable controller (not shown) having logic configured to receive the position signals from switches 90, 148, 160 and provide suitable control signals to each of the power actuators.

The present disclosure relates to closure latch assemblies of the type having a ratchet configured to include only a single closing notch that is directly operable with the main pawl so as to only switch the status of the pawl switch when the pawl moves from its ratchet releasing position to its ratchet holding position. Thus, no further status change occurs if the ratchet is located in an intermediate position between its secondary and primary striker capture positions. Additionally, the use of a second switch in cooperation with another lever that only changes status when the ratchet reaches its secondary striker capture position, specifically, the second switch connected to the lever responsible for the soft close function in order to start the cinching process without the need for significant pretravel. Further, the cinch mechanism can be overridden mechanically and electrically in order to open the door from any ratchet position and even in the event of a cinch mechanism/cinch actuator malfunction.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A closure latch assembly for use with a closure panel in a motor vehicle, comprising:

a ratchet moveable between a striker release position whereat the ratchet is positioned to release a striker, secondary and primary striker capture positions whereat the ratchet is positioned to retain the striker, and a ratchet overtravel position, the ratchet being biased toward its striker release position;

a pawl moveable between a ratchet holding position whereat the pawl is positioned to hold the ratchet in its primary striker capture position and a ratchet releasing position whereat the pawl is located to permit movement of the ratchet to its striker release position, the pawl being biased toward its ratchet holding position and being permitted to move into its ratchet holding position when the ratchet is moved into its ratchet overtravel position;

a latch cinch mechanism including a cinch lever operably interconnected to a cinch link, the cinch link being moveable between a cinch link engaged position whereat the cinch link engages and holds the ratchet in its secondary striker capture position and a cinch link disengage position whereat the cinch link is disengaged from the ratchet, the cinch link being biased toward the cinch link engaged position by a cinch link biasing member and the cinch lever being moveable from a cinch start position to a cinch stop position while the cinch link is located in its cinch link engaged position for causing the cinch link to move from an uncinched position to a cinched position for causing corresponding movement of the ratchet from its secondary striker capture position into is ratchet overtravel position; and a power cinch actuator operable in a cinching state to move the cinch lever from its cinch start position to its cinch stop position.

2. The closure latch assembly of claim 1, wherein the power cinch actuator is also operable in a resetting state to move the cinch lever from its cinch stop position to its cinch start position so as to allow the ratchet to move from its ratchet overtravel position to its primary striker capture position with the pawl located in its ratchet holding position for engaging and holding the ratchet in its primary striker capture position.

3. The closure latch assembly of claim 1, further comprising a latch release mechanism operable for moving the pawl from its ratchet holding position to its ratchet releasing position.

4. The closure latch assembly of claim 3, further comprising a power release actuator for actuating the latch release mechanism.

5. The closure latch assembly of claim 1, further comprising a cinch disengage mechanism operable for moving the cinch link from its cinch link engaged position to its cinch link disengaged position after the ratchet is held in its primary striker capture position by the pawl in its ratchet holding position.

6. The closure latch assembly of claim 5, wherein the cinch disengage mechanism includes a disengage lever operatively connected to the cinch link such that movement of the disengage lever between a non-actuated position and an actuated position causes coordinated movement of the cinch link between its cinch link engaged and cinch link disengaged positions.

7. The closure latch assembly of claim 6, further comprising a power cinch disengage actuator operable for moving the disengage lever between its non-actuated and actuated positions.

8. The closure latch assembly of claim 6, further comprising:

a pawl switch operable to detect and provide a pawl position signal when the pawl is located in its ratchet releasing position;

a disengage lever switch operable to detect and provide a disengage lever position signal when the disengage lever is located in its actuated position; and a cinch home switch operable to detect and provide a cinch home signal when the cinch link is located in its uncinched position.

9. The closure latch assembly of claim 1, further comprising:

a ratchet biasing member for biasing the ratchet toward its striker release position; and a pawl biasing member for biasing the pawl toward its ratchet holding position.

10. The closure latch assembly of claim 1, further comprising:

a latch release mechanism coupled to the pawl and operable in a non-actuated state to hold the pawl in its ratchet holding position and in an actuated state to move the pawl to its ratchet releasing position;

a power release actuator for shifting the latch release mechanism between its non-actuated and actuated states;

a cinch disengage mechanism operable in a non-actuated state to permit the cinch link to be located in its cinch link engaged position and in an actuated state to move the cinch link to its cinch link disengaged position; and a power cinch disengage actuator for shifting the cinch disengage mechanism between its non-actuated and actuated states.

11. The closure latch assembly of claim 10, wherein the cinch disengage mechanism includes a disengage lever connected to the cinch link such that movement of the disengage lever from between first position and a second position causes coordinated movement of the cinch link between its cinch link engaged and cinch link disengaged positions, wherein the power cinch disengage actuator moves the disengage lever from its first position to its second position to shift the cinch disengage mechanism from its non-actuated state into its actuated state.

12. A closure latch assembly for use with a closure panel in a motor vehicle, comprising:

a ratchet moveable between a striker release position whereat the ratchet is positioned to release a striker, secondary and primary striker capture positions whereat the ratchet is positioned to retain the striker, and a ratchet overtravel position, the ratchet being biased toward its striker release position;

a pawl moveable between a ratchet holding position whereat the pawl is positioned to hold the ratchet in its primary striker capture position and a ratchet releasing position whereat the pawl is located to permit movement of the ratchet to its striker release position, the pawl being biased toward its ratchet holding position and being permitted to move into its ratchet holding position when the ratchet is moved into its ratchet overtravel position;

a latch cinch mechanism including a cinch lever operably interconnected to a cinch link, the cinch link being biased toward a cinch link engaged position whereat the cinch link engages and holds the ratchet in its secondary striker capture position while the pawl is in its ratchet releasing position and being moveable against the bias to a cinch link disengage position whereat the cinch link is disengaged from the ratchet, the cinch lever being moveable from a cinch start position to a cinch stop position while the cinch link is located in its cinch link engaged position for causing the cinch link to move from an uncinched position to a cinched position for causing corresponding movement of the ratchet from its secondary striker capture position into is ratchet overtravel position;

a power cinch actuator operable in a cinching state to move the cinch lever from its cinch start position to its cinch stop position;

a cinch disengage mechanism operable for moving the cinch link from its cinch link engaged position to its cinch link disengaged position when the ratchet is held in its primary striker capture position by the pawl in its ratchet holding position; and a power cinch disengage actuator operable for controlling actuation of the cinch disengage mechanism.

13. The closure latch assembly of claim 12, wherein the power cinch actuator is also operable in a resetting state to move the cinch lever from its cinch stop position to its cinch start position so as to allow the ratchet to move from its ratchet overtravel position to its primary striker capture position with the pawl located in its ratchet holding position for engaging and holding the ratchet in its primary striker capture position.

14. The closure latch assembly of claim 12, further comprising a latch release mechanism operable for moving the pawl from its ratchet holding position to its ratchet releasing position.

15. The closure latch assembly of claim 14, further comprising a power release actuator for actuating the latch release mechanism.

16. The closure latch assembly of claim 12, wherein the cinch disengage mechanism includes a disengage lever operatively connected to the cinch link such that movement of the disengage lever between a non-actuated position and an actuated position causes coordinated movement of the cinch link between its cinch link engaged and cinch link disengaged positions, and wherein the power cinch disengage actuator is operable for moving the disengage lever from its non-actuated position to its actuated position.

17. The closure latch assembly of claim 16, further comprising:

a pawl switch operable to detect and provide a pawl position signal when the pawl is located in its ratchet releasing position;

a disengage lever switch operable to detect and provide a disengage lever position signal when the disengage lever is located in its actuated position; and a cinch home switch operable to detect and provide a cinch home switch operable to detect and provide a cinch home signal when the cinch link is located in its uncinched position.

18. A closure latch assembly for use with a closure panel in a motor vehicle, comprising:

a ratchet moveable between a striker release position whereat the ratchet is positioned to release a striker, secondary and primary striker capture positions whereat the ratchet is positioned to retain the striker, and a ratchet overtravel position, the ratchet being biased toward its striker release position;

a pawl moveable between a ratchet holding position whereat the pawl is positioned to hold the ratchet in its primary striker capture position and a ratchet releasing position whereat the pawl is located to permit movement of the ratchet to its striker release position, the pawl being biased toward its ratchet holding position and being permitted to move into its ratchet holding position when the ratchet is moved into its ratchet overtravel position;

a latch cinch mechanism including a cinch link, the cinch link being moveable between a cinch link engaged position whereat the cinch link engages and holds the ratchet in its secondary striker capture position while the pawl is in its ratchet releasing position and a cinch link disengage position whereat the cinch link is disengaged from the ratchet, the cinch link being moveable from an uncinched position to a cinched position while the cinch link is located in its cinch link engaged position for causing corresponding movement of the ratchet from its secondary striker capture position into is ratchet overtravel position;

a power cinch actuator operable in a cinching state to move the cinch link from the uncinched position to the cinched position;

a pawl switch operable to detect and provide a pawl position signal when the pawl is located in its ratchet holding position; and a cinch link switch operable to detect and provide a cinch link position signal when the cinch link is located in its cinch link engaged position.

19. The closure latch assembly of claim 18, wherein the power cinch actuator is operable to enter the cinching state when the cinch link switch detects the cinch link is located in its cinch link engaged position, and to exit the cinching state when the pawl switch detects the pawl is located in its ratchet holding position.

20. The closure latch assembly of claim 18, further comprising a cinch home switch operable to detect and provide a cinch home position signal when the cinch link is located in its uncinched position, wherein the power cinch actuator is operable to enter the cinching state when the cinch link switch detects the cinch link is located in its cinch link engaged position, and to exit the cinching state when the cinch home switch detects the cinch link is located in its uncinched position.

* * * * *